US011067347B2

(12) United States Patent
Karagias

(10) Patent No.: US 11,067,347 B2
(45) Date of Patent: Jul. 20, 2021

(54) FIREARM BOLT ASSEMBLY WITH A PIVOTING HANDLE

(71) Applicant: Theodore Karagias, Seattle, WA (US)

(72) Inventor: Theodore Karagias, Seattle, WA (US)

( * ) Notice: Subject to any disclaimer, the term of this patent is extended or adjusted under 35 U.S.C. 154(b) by 0 days.

(21) Appl. No.: 16/701,004

(22) Filed: Dec. 2, 2019

(65) Prior Publication Data

US 2020/0263942 A1 Aug. 20, 2020

Related U.S. Application Data

(60) Provisional application No. 62/774,032, filed on Nov. 30, 2018.

(51) Int. Cl.
*F41A 3/22* (2006.01)
*F41A 3/72* (2006.01)

(52) U.S. Cl.
CPC . *F41A 3/22* (2013.01); *F41A 3/72* (2013.01)

(58) Field of Classification Search
CPC ..... F41A 3/20; F41A 3/22; F41A 3/24; F41A 3/72
USPC ..... 42/16
See application file for complete search history.

(56) References Cited

U.S. PATENT DOCUMENTS

| | | | | |
|---|---|---|---|---|
| 119,939 | A | 10/1871 | Merrill | |
| 193,060 | A | 7/1877 | Wesson et al. | |
| 467,180 | A | 1/1892 | Mauser | |
| 477,671 | A | 6/1892 | Mauser | |
| 592,239 | A | 10/1897 | Davenport | |
| 652,583 | A | 6/1900 | Baird | |
| 1,331,154 | A * | 2/1920 | Johnson | F41A 19/34 42/16 |
| 1,544,566 | A | 7/1925 | Eickhoff et al. | |
| 1,588,887 | A | 6/1926 | Lassen | |
| 2,123,111 | A * | 7/1938 | King | F41A 3/20 42/16 |
| 2,144,241 | A * | 1/1939 | Wiane | F41A 3/26 89/145 |
| 2,290,778 | A | 7/1942 | Swebilius | |
| 2,341,298 | A | 2/1944 | Sweany | |
| 2,368,708 | A | 2/1945 | Goff et al. | |
| 2,484,977 | A | 10/1949 | Wilcox | |
| 2,514,981 | A | 7/1950 | Walker et al. | |
| 2,543,604 | A | 2/1951 | Singer | |
| 2,558,872 | A | 7/1951 | Miller | |

(Continued)

FOREIGN PATENT DOCUMENTS

DE 4125148 A1 2/1993

OTHER PUBLICATIONS

Anschutz match-trigger, Oct. 2, 1999, 1 page. <<web.archive.org/web.19991002085043//www.championshooters.com/trigger.htm>> accessed on May 18, 2009.

(Continued)

*Primary Examiner* — Bret Hayes
(74) *Attorney, Agent, or Firm* — Perkins Coie LLP

(57) ABSTRACT

Firearms and bolt mechanisms are disclosed herein. The firearm can include a bolt assembly configured to provide leverage for extracting a cartridge. The bolt body can include a main cylindrical body, handle, and a pivot pin extending through a portion of the handle within the cylindrical body. The handle can be rotated relative to the main cylindrical body to push the bolt assembly along an internal passageway of the receiver.

16 Claims, 13 Drawing Sheets

(56) References Cited

U.S. PATENT DOCUMENTS 2,775,836 A 1/1957 Emerson
2,780,145 A 2/1957 Dieudonne
2,881,547 A 4/1959 Butler
3,183,615 A 5/1965 Hirsch
3,198,076 A 8/1965 Stoner
3,253,362 A 5/1966 Gitchell
3,287,842 A 11/1966 Denhoff
3,341,963 A * 9/1967 Seiderman ..... F41A 3/72 42/16
3,380,183 A 4/1968 Arthur et al.
3,610,714 A 10/1971 DeGaeta
3,738,223 A 6/1973 Post et al.
3,830,000 A 8/1974 Browning
3,906,651 A 9/1975 Vesamaa
3,939,679 A 2/1976 Barker et al.
3,949,508 A 4/1976 Elkas
3,950,876 A 4/1976 Wild et al.
3,951,038 A 4/1976 Van Langenhoven
3,951,126 A 4/1976 Rau
3,955,300 A 5/1976 Folsom et al.
3,955,469 A 5/1976 Conley
3,956,967 A 5/1976 Martz
3,958,549 A 5/1976 Johansson et al.
3,960,053 A 6/1976 Conley
3,964,368 A 6/1976 Zimeri Safie
3,975,982 A 8/1976 Terstegge
3,979,849 A 9/1976 Haskins
3,983,270 A 9/1976 Licari et al.
3,985,060 A 10/1976 Conley
3,988,849 A 11/1976 Connellan et al.
3,996,686 A 12/1976 Baker
3,999,461 A 12/1976 Johnson et al.
4,000,575 A 1/1977 Ruger et al.
4,002,156 A 1/1977 Fischer
4,003,152 A 1/1977 Barker et al.
4,004,364 A 1/1977 Chatigny
4,004,496 A 1/1977 Snodgrass et al.
4,011,790 A 3/1977 Folsom et al.
4,014,247 A 3/1977 Tollinger
4,016,668 A 4/1977 Frazier
4,016,669 A 4/1977 Gminder
4,019,480 A 4/1977 Kenaio
4,024,792 A 5/1977 Moller
4,031,840 A 6/1977 Boisrayon et al.
4,048,901 A 9/1977 Ghisoni
4,052,926 A 10/1977 Tollinger
4,054,003 A 10/1977 Wilson
4,058,924 A 11/1977 Mullner
4,065,867 A 1/1978 Storey
4,066,000 A 1/1978 Rostocil
4,069,702 A 1/1978 Hayner
4,085,511 A 4/1978 Kovac
4,103,586 A 8/1978 Tollinger
4,105,030 A 8/1978 Kercso
4,122,621 A 10/1978 Barr
4,123,963 A 11/1978 Junker
4,138,789 A 2/1979 Langsford
4,141,274 A 2/1979 Gerber
4,143,636 A 3/1979 Liepins et al.
4,150,656 A 4/1979 Curran
4,151,670 A 5/1979 Rath
4,151,782 A 5/1979 Allen
4,158,926 A 6/1979 Kordas et al.
4,161,904 A 7/1979 Groen et al.
4,163,334 A 8/1979 Tollinger
4,164,929 A 8/1979 Liepins et al.
4,173,964 A 11/1979 Curran
4,185,537 A 1/1980 Hayashi
4,194,433 A 3/1980 Zellweger et al.
4,194,846 A 3/1980 Zerillo
4,200,028 A 4/1980 Bains
4,227,439 A 10/1980 Gillum
4,232,583 A 11/1980 Harrison
4,245,418 A 1/1981 Kennedy
4,257,310 A 3/1981 Folsom et al.
4,266,358 A 5/1981 Phillips et al.
4,269,386 A 5/1981 Crowe
4,275,640 A 6/1981 Wilhelm
4,282,796 A 8/1981 Stoner et al.
4,296,564 A 10/1981 Oberst
4,301,609 A 11/1981 Peterson et al.
4,301,709 A 11/1981 Bohorquez et al.
4,305,218 A 12/1981 Godsey
4,305,326 A 12/1981 Sallach et al.
4,308,786 A 1/1982 Hayashi
4,316,341 A 2/1982 Landry
4,321,764 A 3/1982 Wilhelm
4,328,737 A 5/1982 Nelson et al.
4,329,803 A 5/1982 Johnson et al.
4,335,643 A 6/1982 Gal
4,336,743 A 6/1982 Horn et al.
4,352,317 A 10/1982 Wilhelm
4,357,888 A 11/1982 Phillips et al.
4,358,985 A 11/1982 Hamilton
4,358,986 A 11/1982 Giorgio
4,358,987 A 11/1982 Wilhelm
4,361,975 A 12/1982 Wilhelm
4,362,397 A 12/1982 Klingenberg
4,378,614 A 4/1983 McKenney
4,383,383 A 5/1983 Landry
4,387,524 A 6/1983 Brint et al.
4,395,938 A 8/1983 Curtis
4,400,900 A 8/1983 Hillberg et al.
4,400,901 A 8/1983 Hillberg
4,407,085 A 10/1983 Hillberg et al.
4,416,186 A 11/1983 Sullivan
4,422,254 A 12/1983 McQueen
4,424,735 A 1/1984 Bacon et al.
4,445,292 A 5/1984 Martin
4,449,312 A 5/1984 Ruger et al.
4,450,751 A 5/1984 Thevis
4,452,001 A 6/1984 Compton
4,453,329 A 6/1984 Brint et al.
4,455,919 A 6/1984 Osborne et al.
4,459,849 A 7/1984 Calamera
4,462,179 A 7/1984 Rogak et al.
4,463,654 A 8/1984 Barnes et al.
4,466,417 A 8/1984 Mulot et al.
4,467,698 A 8/1984 Perrine
4,468,876 A 9/1984 Ghisoni
4,468,877 A 9/1984 Karvonen
4,469,006 A 9/1984 Teppa
4,471,549 A 9/1984 Brint et al.
4,475,437 A 10/1984 Sullivan
4,481,859 A 11/1984 Dix
4,492,145 A 1/1985 Curtis
4,494,439 A 1/1985 Sawyer
4,499,684 A 2/1985 Repa
4,502,367 A 3/1985 Sullivan
4,505,182 A 3/1985 Sullivan
4,512,236 A 4/1985 Thevis et al.
4,515,064 A 5/1985 Hohrein
4,522,105 A 6/1985 Atchisson
4,522,106 A 6/1985 Sullivan
4,523,510 A 6/1985 Wilhelm
4,531,444 A 7/1985 Jackson
4,532,852 A 8/1985 Hance et al.
4,547,988 A 10/1985 Nilsson
4,551,936 A 11/1985 Chauvet
4,553,468 A 11/1985 Castellano et al.
4,553,469 A 11/1985 Atchisson
4,555,205 A 11/1985 Hiroyasu et al.
4,563,936 A 1/1986 Cleary et al.
4,563,937 A 1/1986 White
4,569,145 A 2/1986 Ruger et al.
4,570,369 A 2/1986 Gerfen
4,579,034 A 4/1986 Holloway
4,587,879 A 5/1986 Savioli
4,589,326 A 5/1986 Kuckens et al.
4,589,327 A 5/1986 Smith
4,590,697 A 5/1986 Ruger et al.
4,597,211 A 7/1986 Miles
4,648,190 A 3/1987 Allen
4,653,210 A 3/1987 Poff

(56) References Cited

U.S. PATENT DOCUMENTS 4,654,993 A 4/1987 Atchisson
4,656,919 A 4/1987 Farinacci et al.
4,664,015 A 5/1987 Kennedy
4,665,793 A 5/1987 Cleary et al.
4,671,005 A 6/1987 Jewell
4,672,761 A 6/1987 Hart
4,672,762 A 6/1987 Nilsson
4,677,897 A 7/1987 Barrett
4,680,884 A 7/1987 Smith, Jr. et al.
4,693,170 A 9/1987 Atchisson
4,698,931 A 10/1987 Larsson
4,700,608 A 10/1987 Pettinga et al.
4,709,617 A 12/1987 Anderson
4,709,686 A 12/1987 Taylor et al.
4,719,841 A 1/1988 Perrine
4,723,369 A 2/1988 Badali
4,727,670 A 3/1988 Krouse
4,732,074 A 3/1988 Normand
4,754,567 A 7/1988 Lehfeldt et al.
4,774,929 A 10/1988 Milliman
4,787,288 A 11/1988 Miller
4,791,851 A 12/1988 Stoner
4,791,908 A 12/1988 Pellis
4,821,621 A 4/1989 Lorenzo
4,856,410 A 8/1989 Anderson
4,867,040 A 9/1989 Barrett
4,870,770 A 10/1989 Forbes et al.
4,872,391 A 10/1989 Stoner
4,874,367 A 10/1989 Edwards
4,879,827 A 11/1989 Gentry
4,881,517 A 11/1989 Wackrow et al.
4,890,405 A 1/1990 Krouse
4,893,545 A 1/1990 Sanderson et al.
4,893,547 A 1/1990 Atchisson
4,897,949 A 2/1990 Whiteing
4,908,970 A 3/1990 Bell
4,920,677 A 5/1990 Schuerman
4,926,574 A 5/1990 Rieger
4,930,238 A 6/1990 Poff
4,930,399 A 6/1990 Trevor
4,937,964 A 7/1990 Crandall
4,938,116 A 7/1990 Royster
4,966,063 A 10/1990 Sanderson et al.
4,974,499 A 12/1990 Sanderson et al.
4,977,815 A 12/1990 Stephens
4,987,693 A 1/1991 Brooks
4,989,357 A 2/1991 Norman et al.
5,012,604 A 5/1991 Rogers
5,018,292 A 5/1991 West
5,024,138 A 6/1991 Sanderson et al.
5,024,139 A 6/1991 Knight et al.
5,035,692 A 7/1991 Lyon et al.
5,050,480 A 9/1991 Knight et al.
5,050,481 A 9/1991 Knight et al.
5,054,365 A 10/1991 Wissing
5,065,662 A 11/1991 Bullis et al.
5,067,266 A 11/1991 Findlay
5,073,165 A 12/1991 Edwards
5,078,043 A 1/1992 Stephens
5,081,780 A 1/1992 Lishness et al.
5,086,578 A 2/1992 Lishness et al.
5,096,155 A 3/1992 Fitzgerald
5,105,570 A 4/1992 Lishness et al.
5,127,310 A 7/1992 Lishness et al.
5,133,331 A 7/1992 Hutchinson
5,155,292 A 10/1992 Rostcil et al.
5,157,209 A 10/1992 Dunn
5,161,516 A 11/1992 Ekstrom
5,164,534 A 11/1992 Royster
5,205,942 A 4/1993 Fitzgerald
5,229,539 A 7/1993 Rommel
5,259,137 A 11/1993 Blenk et al.
5,259,138 A 11/1993 Scirica
5,280,778 A 1/1994 Kotsiopoulos
5,299,722 A 4/1994 Cheney
5,308,945 A 5/1994 Van Handel et al.
5,325,760 A 7/1994 Dennis
5,329,685 A 7/1994 Gillespie
5,349,938 A 9/1994 Farrell
5,357,939 A 10/1994 Tentler et al.
5,359,921 A 11/1994 Wolff et al.
5,363,581 A 11/1994 Blenk et al.
5,370,036 A 12/1994 Stoner
5,383,389 A 1/1995 Wolff et al.
5,410,135 A 4/1995 Pollart et al.
5,413,083 A 5/1995 Jones
5,440,963 A 8/1995 Szecsei
5,458,046 A 10/1995 Blenk et al.
5,469,853 A 11/1995 Law et al.
5,484,092 A 1/1996 Cheney
5,487,233 A 1/1996 Jewell
5,497,758 A 3/1996 Dobbins et al.
5,499,569 A 3/1996 Schuetz
5,509,399 A 4/1996 Poor
5,515,838 A 5/1996 Anderson
5,522,374 A 6/1996 Clayton
5,551,180 A 9/1996 Findlay et al.
5,558,077 A 9/1996 Linsmeyer
5,572,982 A 11/1996 Williams
5,585,590 A 12/1996 Ducolon
5,586,545 A 12/1996 McCaslin
5,615,662 A 4/1997 Tentler et al.
5,649,520 A 7/1997 Bednar
5,653,051 A 8/1997 Pons et al.
5,653,213 A 8/1997 Linsmeyer
5,659,992 A 8/1997 Mistretta
5,673,505 A 10/1997 Phillips
5,673,679 A 10/1997 Walters
5,680,853 A 10/1997 Clayton
5,682,699 A 11/1997 Gentry
5,691,497 A 11/1997 Weichert et al.
5,701,878 A 12/1997 Moore et al.
5,704,342 A 1/1998 Gibson et al.
5,718,074 A 2/1998 Keeney
5,722,193 A 3/1998 Post
5,722,194 A * 3/1998 Wurger ..... F41A 3/20 42/69.02
5,722,383 A 3/1998 Tippmann, Sr. et al.
5,724,759 A 3/1998 Kilham
5,726,377 A 3/1998 Harris et al.
5,736,667 A 4/1998 Munostes et al.
5,743,039 A 4/1998 Garrett
5,770,814 A 6/1998 Ealovega
5,771,875 A 6/1998 Sullivan
5,783,753 A 7/1998 Kellerman
5,784,818 A 7/1998 Otteson
5,787,629 A 8/1998 Campbell et al.
5,813,158 A 9/1998 Campbell et al.
5,826,362 A 10/1998 Lyons
5,827,992 A 10/1998 Harris et al.
5,857,280 A 1/1999 Jewell
5,878,736 A 3/1999 Lotuaco, III
5,900,577 A 5/1999 Robinson et al.
5,913,303 A 6/1999 Kotsiopoulos
5,915,934 A 6/1999 Knight et al.
5,926,988 A * 7/1999 Casull ..... F41A 3/72 42/16
5,939,657 A 8/1999 Morgado
5,954,043 A 9/1999 Mayville et al.
5,974,940 A 11/1999 Madni et al.
6,024,077 A 2/2000 Kotsiopoulos
6,065,460 A 5/2000 Lotuaco, III
6,070,352 A 6/2000 Daigle
6,073,380 A 6/2000 Hauser et al.
6,101,918 A 8/2000 Akins
6,131,324 A 10/2000 Jewell
6,142,058 A 11/2000 Mayville et al.
6,164,001 A 12/2000 Lee
6,176,169 B1 1/2001 Rostocil
6,189,253 B1 2/2001 Knight et al.
6,205,990 B1 3/2001 Adkins
6,209,249 B1 4/2001 Borden
6,226,915 B1 5/2001 Kotsiopoulos
6,234,058 B1 5/2001 Morgado

(56) References Cited

U.S. PATENT DOCUMENTS

| | | | |
|---|---|---|---|
| 6,263,776 | B1 | 7/2001 | Rostocil |
| 6,293,203 | B1 | 9/2001 | Alexander et al. |
| 6,305,113 | B1 | 10/2001 | Calvete |
| 6,345,460 | B2 | 2/2002 | Hashman |
| 6,345,461 | B1 | 2/2002 | Constant et al. |
| 6,345,462 | B1 | 2/2002 | Mikuta et al. |
| 6,345,463 | B1 | 2/2002 | Baer, Sr. |
| 6,354,320 | B1 | 3/2002 | Kolacz et al. |
| 6,360,467 | B1 | 3/2002 | Knight |
| 6,360,468 | B1 | 3/2002 | Constant et al. |
| 6,360,469 | B1 | 3/2002 | Mikuta et al. |
| 6,360,470 | B1 | 3/2002 | Constant et al. |
| 6,401,378 | B1 | 6/2002 | Ockenfuss |
| 6,401,592 | B1 | 6/2002 | Rostocil |
| 6,403,602 | B1 | 6/2002 | Crooks et al. |
| 6,412,206 | B1 | 7/2002 | Strayer |
| 6,412,208 | B1 | 7/2002 | Mikuta et al. |
| 6,425,386 | B1 | 7/2002 | Adkins |
| 6,432,559 | B1 | 8/2002 | Tompkins et al. |
| 6,460,281 | B1 | 10/2002 | Schaeffer |
| 6,470,872 | B1 | 10/2002 | Tiberius et al. |
| 6,477,802 | B2 | 11/2002 | Baer, Sr. |
| 6,508,025 | B1 | 1/2003 | Du |
| 6,516,791 | B2 | 2/2003 | Perrone |
| 6,520,172 | B2 | 2/2003 | Perrone |
| 6,530,305 | B1 | 3/2003 | MacLeod et al. |
| 6,532,876 | B1 | 3/2003 | Ramirez et al. |
| 6,553,706 | B1 | 4/2003 | Gancarz et al. |
| 6,560,909 | B2 | 5/2003 | Cominolli |
| 6,594,938 | B2 | 7/2003 | Horton |
| 6,604,311 | B1 | 8/2003 | Laney et al. |
| 6,625,917 | B2 | 9/2003 | Murello et al. |
| 6,631,709 | B2 | 10/2003 | Carter et al. |
| 6,634,129 | B1 | 10/2003 | Freeman, Jr. |
| 6,650,669 | B1 | 11/2003 | Adkins |
| 6,668,478 | B2 | 12/2003 | Bergstrom |
| 6,679,150 | B1 | 1/2004 | Ramirez et al. |
| 6,681,511 | B1 | 1/2004 | Huber |
| 6,698,918 | B2 | 3/2004 | Durand |
| 6,701,909 | B2 | 3/2004 | Tiberius et al. |
| 6,708,685 | B2 | 3/2004 | Masse |
| 6,718,680 | B2 | 4/2004 | Roca et al. |
| 6,722,072 | B1 | 4/2004 | McCormick |
| 6,729,322 | B2 | 5/2004 | Schavone |
| 6,735,897 | B1 | 5/2004 | Schmitter et al. |
| 6,760,991 | B1 | 7/2004 | Gentry |
| 6,782,791 | B2 | 8/2004 | Moore |
| 6,789,342 | B2 | 9/2004 | Wonisch et al. |
| 6,796,067 | B2 | 9/2004 | Popikow |
| 6,820,533 | B2 | 11/2004 | Schuerman |
| 6,820,608 | B2 | 11/2004 | Schavone |
| 6,832,605 | B2 | 12/2004 | Farrell |
| 6,874,492 | B1 | 4/2005 | Schavone |
| 6,892,718 | B2 | 5/2005 | Tiberius et al. |
| 6,901,689 | B1 | 6/2005 | Bergstrom |
| 6,907,687 | B2 | 6/2005 | Rousseau et al. |
| 6,907,813 | B2 | 6/2005 | Gablowski |
| 6,919,111 | B2 | 7/2005 | Swoboda et al. |
| 6,925,744 | B2 | 8/2005 | Kincel |
| 6,948,273 | B2 | 9/2005 | Baker |
| 7,051,467 | B1 | 5/2006 | Huber |
| 7,181,680 | B2 | 2/2007 | Lin et al. |
| 7,331,135 | B2 | 2/2008 | Shimi |
| 7,340,987 | B1 | 3/2008 | Williams |
| 7,363,740 | B2 | 4/2008 | Kincel |
| 7,430,827 | B1 | 10/2008 | Huber |
| 7,555,900 | B1 | 7/2009 | Vallance et al. |
| 7,596,900 | B2 | 10/2009 | Robinson et al. |
| 7,743,543 | B2 | 6/2010 | Karagias |
| 7,827,724 | B1 | 11/2010 | Spinelli |
| 8,069,600 | B2 | 12/2011 | Rousseau et al. |
| 8,099,895 | B2 | 1/2012 | Farley et al. |
| 8,215,045 | B2 | 7/2012 | Mitchell |
| 8,230,633 | B1 | 7/2012 | Sisk |
| 8,302,340 | B1 | 11/2012 | Irwin |
| 8,307,575 | B1 | 11/2012 | Battaglia |
| 8,474,171 | B1 | 7/2013 | Simmons |
| 8,769,854 | B1 | 7/2014 | Battaglia |
| 8,819,976 | B1 | 9/2014 | Kellgren |
| 8,997,620 | B2 | 4/2015 | Brown |
| 9,097,478 | B1 | 8/2015 | Karagias |
| 9,188,399 | B1 | 11/2015 | Findlay et al. |
| 9,328,980 | B1 | 5/2016 | Doto |
| 9,377,255 | B2 | 6/2016 | Karagias |
| 9,404,694 | B2 | 8/2016 | Hochstrate et al. |
| 9,574,834 | B2 | 2/2017 | Karagias |
| 10,082,356 | B2 | 9/2018 | Karagias |
| 10,458,733 | B2 | 10/2019 | Karagias |
| 2002/0071349 | A1 | 6/2002 | Durand |
| 2002/0153982 | A1 | 10/2002 | Jones et al. |
| 2005/0011346 | A1 | 1/2005 | Wolff et al. |
| 2006/0090387 | A1* | 5/2006 | Zeh ..... F41A 15/14 42/76.01 |
| 2006/0277810 | A1 | 12/2006 | Leitner-Wise |
| 2007/0079539 | A1 | 4/2007 | Karagias |
| 2007/0116546 | A1 | 5/2007 | Dearing |
| 2008/0005951 | A1 | 1/2008 | Gorzen |
| 2009/0049730 | A1* | 2/2009 | Caulley ..... F41A 19/13 42/69.02 |
| 2010/0170130 | A1 | 7/2010 | Tertin |
| 2010/0229445 | A1 | 9/2010 | Patel |
| 2010/0281732 | A1 | 11/2010 | Laney et al. |
| 2011/0030261 | A1 | 2/2011 | Karagias |
| 2011/0099874 | A1 | 5/2011 | Zedrosser |
| 2012/0055058 | A1 | 3/2012 | Picard et al. |
| 2012/0073177 | A1* | 3/2012 | Laney ..... F42B 5/025 42/16 |
| 2012/0210859 | A1 | 8/2012 | Doll et al. |
| 2012/0297656 | A1 | 11/2012 | Langevin et al. |
| 2013/0139424 | A1 | 6/2013 | Devine |
| 2014/0013641 | A1* | 1/2014 | Warburton ..... F41A 3/72 42/16 |
| 2014/0076144 | A1 | 3/2014 | Gomez |
| 2014/0144314 | A1 | 5/2014 | Jensen |
| 2014/0224114 | A1 | 8/2014 | Faxon |
| 2014/0230297 | A1 | 8/2014 | Larson et al. |
| 2015/0052794 | A1 | 2/2015 | Underwood et al. |
| 2015/0198394 | A1 | 7/2015 | Hochstrate et al. |
| 2015/0233656 | A1 | 8/2015 | Karagias |
| 2015/0276333 | A1* | 10/2015 | DiOrio ..... F41A 3/24 42/16 |
| 2016/0033218 | A1 | 2/2016 | Folkestad et al. |
| 2016/0187082 | A1 | 6/2016 | Pizano |
| 2016/0209136 | A1 | 7/2016 | Schuetz |
| 2016/0238334 | A1* | 8/2016 | Pflaumer ..... F41A 35/06 |
| 2017/0191773 | A1 | 7/2017 | Oz et al. |
| 2018/0195818 | A1* | 7/2018 | Schafer ..... F41A 3/72 |

OTHER PUBLICATIONS

Metcalf, D. "Innovative, Remarkable, Reliable . . . Getting Inside Savage's Accutrigger," Long Gun Reviews. <<www.shootingtimes.com/longgun_reviews/savage_0813/>> accessed Jun. 6, 2005, 6 pages.

Quinn, J. "Savage Arms' New AccuTrigger," Dec. 28, 2002, 6 pages. <<www.gunblast.com/Savage_Accutrigger.htm>>.

* cited by examiner

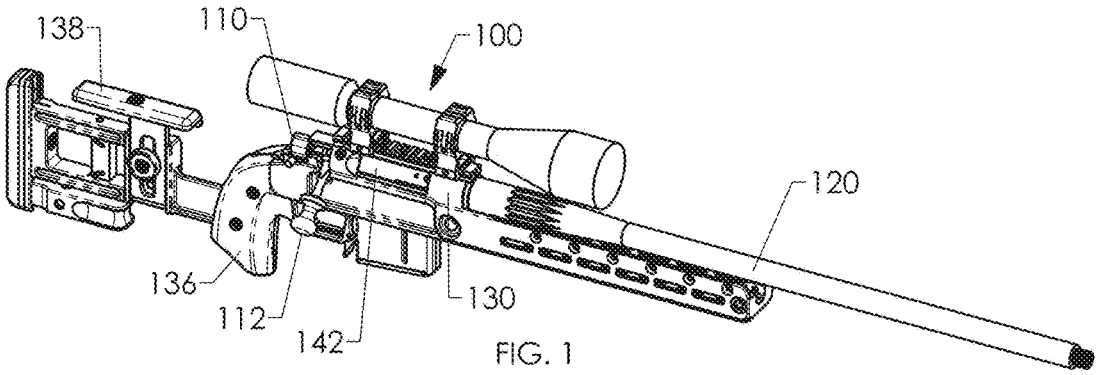
FIG. 1
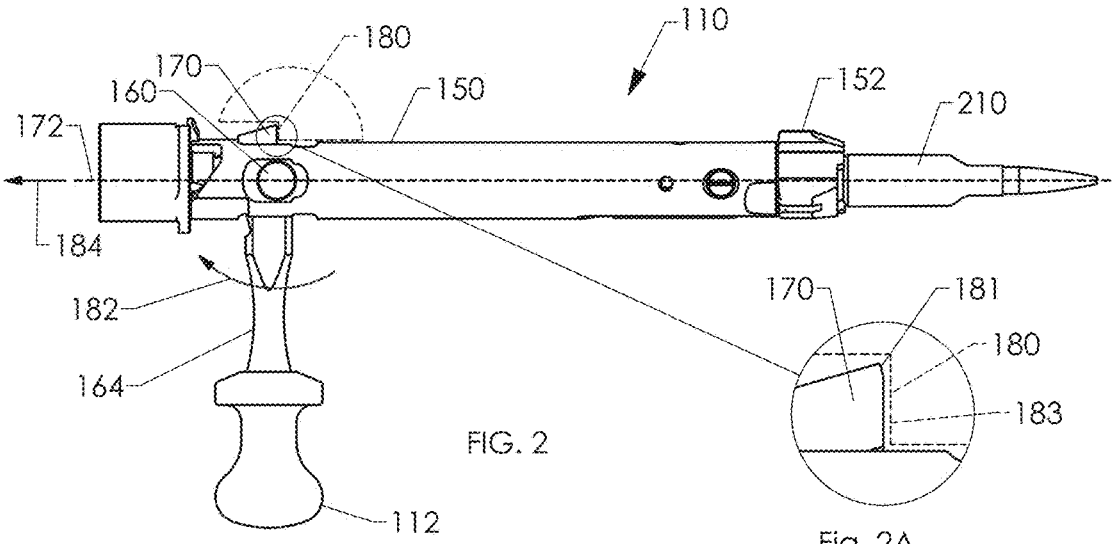
FIG. 2
Fig. 2A
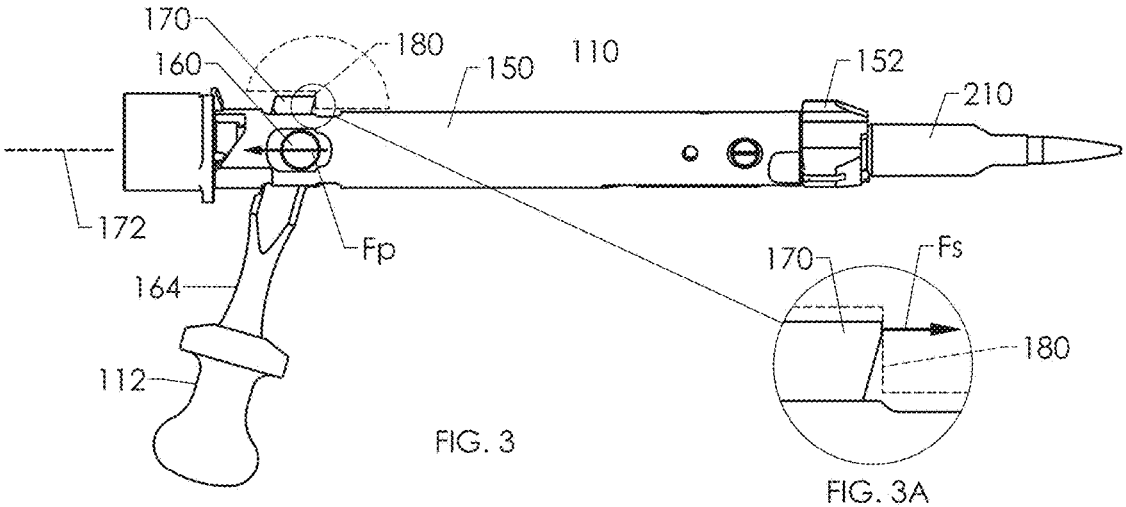
FIG. 3
FIG. 3A

FIREARM BOLT ASSEMBLY WITH A PIVOTING HANDLE

CROSS-REFERENCE TO RELATED APPLICATION

This application claims the benefit under 35 U.S.C. § 119(e) of U.S. Provisional Patent Application No. 62/774,032 filed Nov. 30, 2018, which is incorporated herein by reference in its entirety.

TECHNICAL FIELD

The present invention relates generally to firearms. More specifically, the invention relates to firearms with bolt assemblies with pivoting handles for assisting with cartridge extraction.

BACKGROUND

Manual bolt-action rifles have bolt mechanisms configured to load cartridges into a chamber for firing and to remove empty cartridge shells from the chamber for ejection. Conventional bolt mechanisms have bolt handles fixedly connected to bolt bodies. Spent cartridges often stick to sidewalls of the chamber due to expansion of the cartridge bodies due to pressure built up during firing. Unfortunately, this can often require relatively high extraction forces for dislodging the spent cartridge. A helical extraction cam is typically located at the aft end of the receiver for generating such high forces.

BRIEF DESCRIPTION OF THE DRAWINGS

Non-limiting and non-exhaustive embodiments are described with reference to the following drawings. The same reference numerals refer to like parts throughout the various views, unless otherwise specified.

FIG. 1 is an isometric view of a firearm in accordance with one or more embodiments.

FIG. 2 is a top view of a portion of the firearm of FIG. 1 having a bolt assembly with a pivoting handle in an unlocked position for extracting a casing.

FIG. 2A is a detailed view of a handle shoulder contacting a receiver shoulder of FIG. 2.

FIG. 3 is a top view of the portion of the firearm after the handle has been rotated rearwardly to leverage the bolt assembly along the receiver.

FIG. 3A is a detailed view of the handle shoulder and receiver shoulder of FIG. 3.

DETAILED DESCRIPTION

Figure 4:
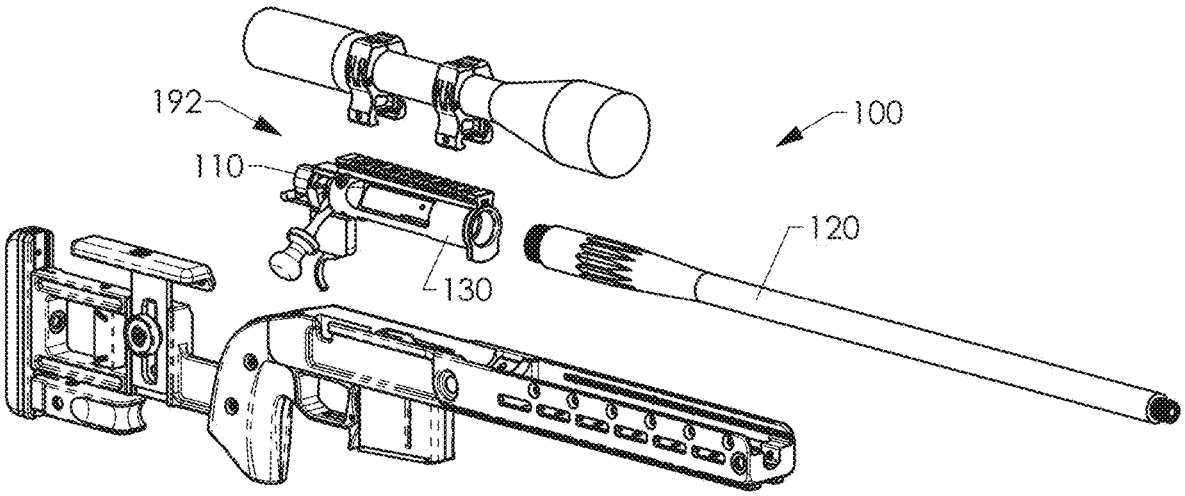
FIG. 4 is a partially exploded isometric view of the firearm in accordance with one embodiment.

The present technology is generally directed to, for example, bolt action firearms, bolt mechanisms, receivers and/or receiver-bolt connections and interactions. Specific details of numerous embodiments of the technology are described below with reference to FIGS. 1-34. A person of ordinary skill in the art will understand that the technology can have other embodiments with additional elements and features, or the technology can have other embodiments without several of the features shown and described below with reference to FIGS. 1-34. The terms "rearward", "forward", "proximal", and "distal" are used to describe the illustrated embodiments and are used consistently with the description of non-limiting exemplary applications. The terms rearward/aft/proximal and forward/fore/distal are used in reference to the user's body when a user fires a firearm, unless the context clearly indicates otherwise.

Overview

In some embodiments, a bolt mechanism can include a pivoting bolt handle that acts as a lever that enables extraction of a cartridge from a receiver with significant force. The rotation of a main bolt body can be limited to, for example, unlocking/locking the bolt mechanism. The bolt handle can be rotated (e.g., rotated in the rearward/proximal direction) to linearly drive the unlocked bolt mechanism along the receiver while a pinned-connection can prevent or limit moments applied by the bolt handle to a main bolt body. This offers a tremendous advantage over traditional bolt actions which relay on, for example, a helical extraction cam along the receiver.

In some embodiments, a firearm assembly can include a receiver and a bolt mechanism. The receiver can have one or more receiver shoulders. The bolt mechanism can include a bolt body, a handle, and a handle pin rotatably coupling the handle to another component of the bolt mechanism. The handle can be rotated to lever the bolt body along the receiver. The pinned connection can substantially prevent or limit bolt body rotation, such as off-axis rotation. This allows the bolt mechanism to be pushed along the receiver while maintaining bolt body alignment. In one embodiment, the handle pin pivotally connects the handle to a central region (e.g., a region along a mid-sagittal plane or a center plane) of the bolt body. When the handle is rotated, a handle shoulder can push against the receiver shoulder facing the bolt body. The rotating handle applies a force to the handle pin in the opposite direction as the force applied to the receiver shoulder. This causes the displacement of the bolt body along a passageway of the receiver. In some embodiments, the pinned-connection limits, reduces, or substantially prevents lateral movement of the bolt body (e.g., off axis rotation) due to the handle leveraging the bolt mechanism rearwardly. To unlock the bolt mechanism, the handle is rotated about a longitudinal axis of the bolt body to rotate the bolt mechanism from a locked to unlocked position. The handle can be rotated about a handle axis of rotation (e.g., an axis of rotation generally perpendicular to the longitudinal axis of the bolt mechanism) to drive the bolt body in the aft direction relative to the receiver.

In some embodiments, a bolt mechanism has a pivoting handle with an arm and a handle shoulder. The handle shoulder is positionable to contact a receiver shoulder such that a bolt body is leveraged rearwardly by rotating the handle with respect to the bolt body. The bolt body can be driven rearwardly to extract at least a portion of a cartridge from a firing chamber. In certain embodiments, the arm and shoulder are positioned on opposing lateral sides of the bolt body. For example, the handle shoulder and the arm can protrude from diametrically opposed positions along the bolt body. The bolt body can be a generally cylindrical, hollow tube surrounding at least a portion of the handle and/or handle pin. In certain embodiments, the handle can have a main body located between the arm and the handle shoulder. The main body can include a pin opening through which the handle pin extends and a firing pin assembly passageway. The handle can have a one-piece or multi-piece construction and can be made, in whole or in part, of metal, rigid plastic, composite materials, or other suitable rigid material.

In further embodiments, a firearm has a bolt assembly with a pivoting bolt handle used for spent cartridge extraction, and a cocking mechanism that is located behind the bolt handle pivot. A firing pin passes through a pin, which pivotally couples the handle to a main body.

In yet further embodiments, a bolt assembly for a bolt action rifle has a pivoting handle attached to a main bolt body by a pivot pin. The pivot pin passes through an approximately cylindrical body of the bolt. A firing pin assembly passes through the bolt handle.

In further embodiments, a bolt assembly for a bolt action rifle can have a pivoting handle with a short portion and a long portion. The short portion protrudes from the side of the bolt opposite the long portion of the handle. The short portion is configured to contact the receiver so that the bolt assembly can be levered in a proximal or rearward direction in order to extract at least a portion of a cartridge from a chamber. In some embodiments, the short portion can include a shoulder having a contact surface that lies along an imaginary plane generally perpendicular to a longitudinal axis of the bolt assembly. When the handle is rotated relative to the body of the bolt assembly, the shoulder can press against the receiver to drive the main body of the bolt assembly along the receiver in the rearward direction. In one embodiment, the main body of the bolt is pivotally connected to the handle such that substantially no movements, attributable to the pivoting handle, are applied to the main body when the handle is pivoted to displace the main body along the receiver.

In some embodiments, a bolt mechanism for a bolt action rifle includes a main bolt body configured to move along a passageway of a receiver and a handle. The handle is rotatably coupled to the main bolt body such that rotation of the handle relative to the main bolt body produces an extraction force with a line of action extending along the passageway. The line of action can be substantially parallel to a longitudinal axis of the main bolt body. The main bolt body can be kept aligned with the passageway of the receiver while the handle pushes against an internal wall of the receiver to leverage the bolt mechanism away from a firing chamber.

Bolt-Action Firearms

FIG. 1 is an isometric view of a firearm 100 in accordance with one or more embodiments. The firearm 100 can include a bolt assembly or mechanism 110 ("bolt mechanism 110"), a barrel 120, a receiver 130, a grip 136, and a stock assembly 138. The bolt mechanism 110 can be used to load a cartridge into a firing chamber and can hold a shell (or casing) of a cartridge during firing. The bolt mechanism 110 is configured to leverage spent shells from the chamber. For example, mechanical advantage provided by the bolt mechanism 110 can help dislodge an expanded shell from the chamber of the firearm, even if the shell has been expanded a significant amount during the firing process. The firearm 100 can be repeatedly loaded, discharged, and unloaded using minimal user-applied forces. In operation, after firing the projectile, the bolt mechanism 110 can be unlocked by vertically rotating a bolt handle 112 ("handle 112") from a lowered forward locked position (illustrated in FIG. 1) to a raised forward unlocked position. After unlocking the bolt mechanism 110, the handle 112 can then be rearwardly rotated to dislodge the spent cartridge. A pinned-connection can prevent or limit moments applied by the handle 112 to a main bolt body. After dislodging the spent cartridge, the handle 112 can be pulled rearwardly to slide the bolt mechanism 110 rearwardly along the receiver 130 until the spent cartridge is ejected via an ejection port 142 (see FIGS. 14, 15, and 16). After expelling the cartridge, the bolt mechanism 110 can be returned to the forward lowered position to reload the firearm 100.

FIG. 2 is a top plan view of the unlocked bolt mechanism 110 after the handle 112 has been moved from a forward locked position (FIG. 1) to an unlocked position in accordance with one embodiment. FIG. 2A is a detailed view of a handle shoulder 170 contacting an internal receiver shoulder 180 (illustrated in phantom line) of the receiver 130. Referring now to FIG. 2, the bolt mechanism 110 can include a cylindrical bolt body 150, a lug 152, and a handle pin 160. The handle 112 extends through the bolt body 150 and has an elongated arm 164 ("arm 164") and a handle shoulder 170. The handle shoulder 170 and the arm 164 are located on opposites sides of a longitudinal axis or midplane plane 172 of the bolt mechanism 110. As the handle 112 pivots rearwardly (indicated by arrow 182), the handle shoulder 170 contacts the stationary receiver shoulder 180 such that the handle 112 displaces the handle pin 160 and bolt body 150 rearwardly (indicated by arrow 184). The handle pin 160 is freely rotatable relative to the bolt body 150 to minimize, reduce, or substantially prevent applied movements (e.g., moments about an axis of the handle pin 160) from being applied to the bolt body 150. This pinned connection ensures proper axial alignment of the bolt body 150 with an internal passageway of the receiver 130.

Referring now to FIG. 2A, an end 181 of the shoulder 170 can serve as a pivot point. When a user pulls rearwardly on the handle 112, the end 181 can remain generally stationary with respect to a surface 183 of the receiver shoulder 180. In other embodiments, the end 181 can have a rounded configuration for sliding along the surface 183 during handle rotation. The configuration of the shoulder 171 can be selected based on the configuration of the receiver and bolt body 150.

FIG. 3 is a top plan view of the bolt mechanism 110 with the handle 112 in a rotated-rearward position after the bolt body 150 has been displaced rearwardly along the receiver. FIG. 3A is a detailed view of the shoulder 170 contacting the receiver shoulder 180. As the handle 112 is rotated from the forward position (FIG. 2) to the rotated-rearward position (FIG. 3), the shoulder 171 can apply a force $F_s$ (FIG. 3A) to the shoulder 180 to produce an axial force $F_P$ applied to the pin 160. The axial force $F_P$ is proportional to force applied to the handle 112 by the user. In some embodiments, the line of action of the force $F_P$ is generally aligned or collinear with the axis 172 (FIG. 2) of the bolt body 150. The direction of the axial force $F_P$ can be generally parallel to the longitudinal axis 172 of the bolt body 150 to limit frictional forces between the bolt mechanism 110 and the receiver. The mechanical advantage provided by this arrangement can be equal to or greater than about 2, about 5, about 10, about 15, or about 20 to overcome sticking of the cartridge case to the firing chamber wall. The configuration of the bolt mechanism 110 (e.g., length of the arm 164) can be selected to achieve other mechanical advantages.

FIG. 4 is an exploded isometric view of the firearm 100 in accordance with an embodiment. An upper or action assembly 192 ("assembly 192") can include the bolt mechanism 110 and the receiver 130. Components and operation of the assembly 192 are discussed in connection with FIGS. 5-16.

Figure 5:
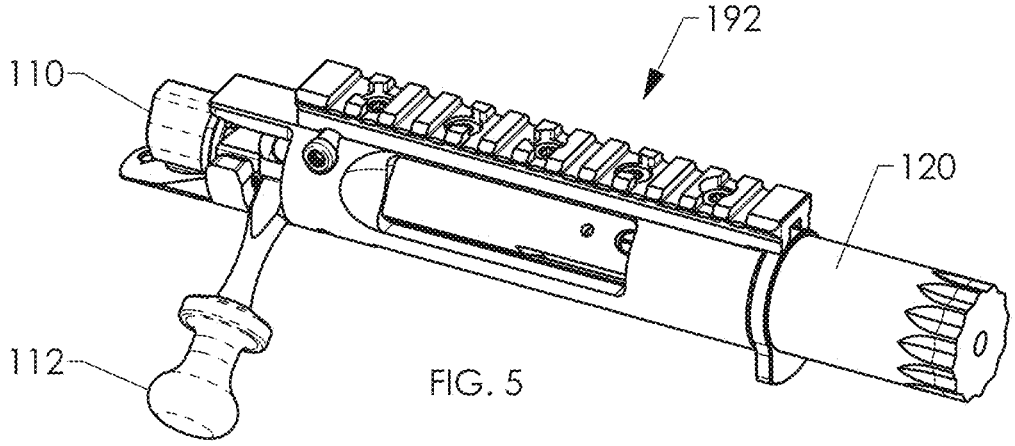
FIG. 5 is an isometric view of an action assembly with a bolt mechanism in a closed position in accordance with one embodiment.
Figure 6:
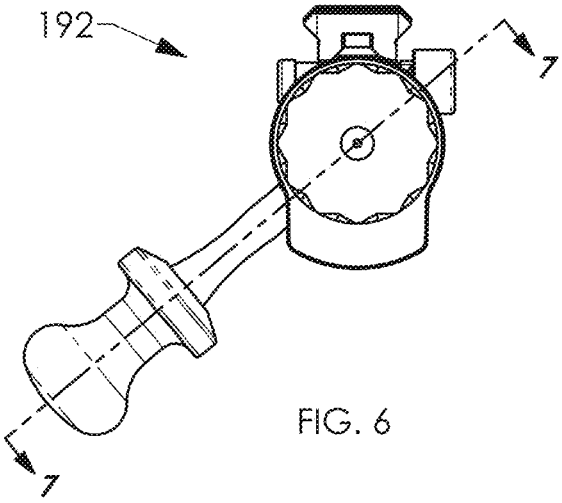
FIG. 6 is a front view of the assembly of FIG. 5.
Figure 7:
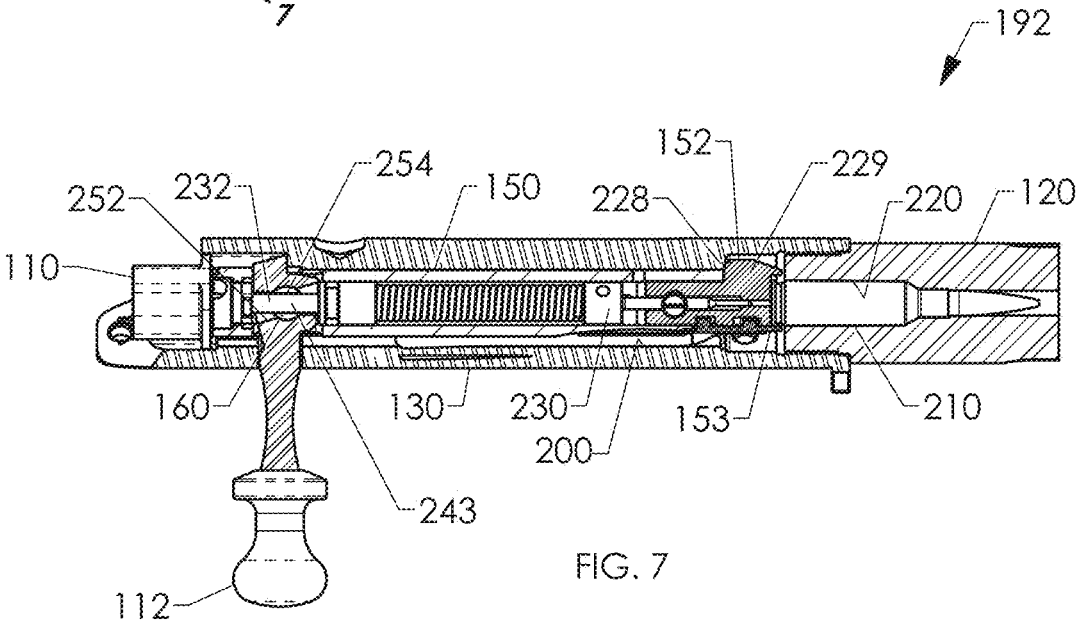
FIG. 7 is a cross-sectional view of the assembly taken along line 7-7 of FIG. 6.

FIG. 5 is an isometric view of the assembly 192 with the bolt mechanism 110 in the ready-to-fire locked configuration. FIG. 6 is a front view of the assembly 192 of FIG. 5. FIG. 7 is a cross-sectional view of the assembly 192 taken along line 7-7 of FIG. 6. Referring now to FIG. 7, the bolt mechanism 110 extends forwardly through a passageway 200 of the receiver 130. An extractor assembly 153 is configured to hold the rim of the cartridge 210, illustrated in a firing chamber 220. The lug 152 of a head 229 is held captivity between a forward-facing shoulder 228 and the barrel 120. A firing pin assembly 230 extends longitudinally through the bolt body 150. In some embodiments, a striker screw 232 extends through an opening 252 of the handle 112 and a through-hole or opening 254 in the pin 160. The opening 252 is large enough to allow rotation of the handle 112 relative to the striker screw 232. The receiver 130 has a cam-less aft end to allow the bolt mechanism 110 to be translated proximally from the receiver 130. For example, the bolt body 150 can be translated in the proximal direction while the bolt body 150 is substantially rotationally fixed (e.g., less than 5, 3, or 2 degrees of rotation) relative to the receiver 130.

Figure 8:
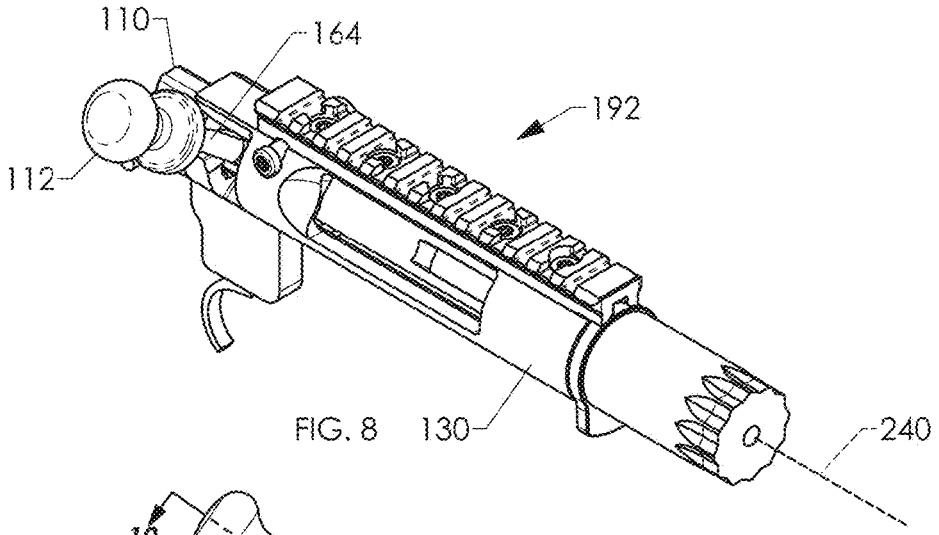
FIG. 8 is an isometric view of the action assembly with the bolt mechanism in an unlocked position for allowing cartridge extraction in accordance with one embodiment.
Figure 9:
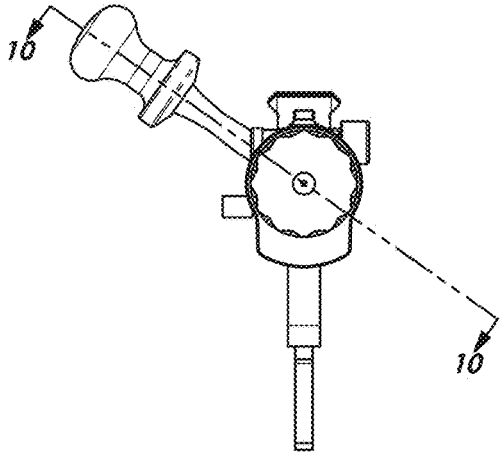
FIG. 9 is a front view of the assembly of FIG. 8.
Figure 10:
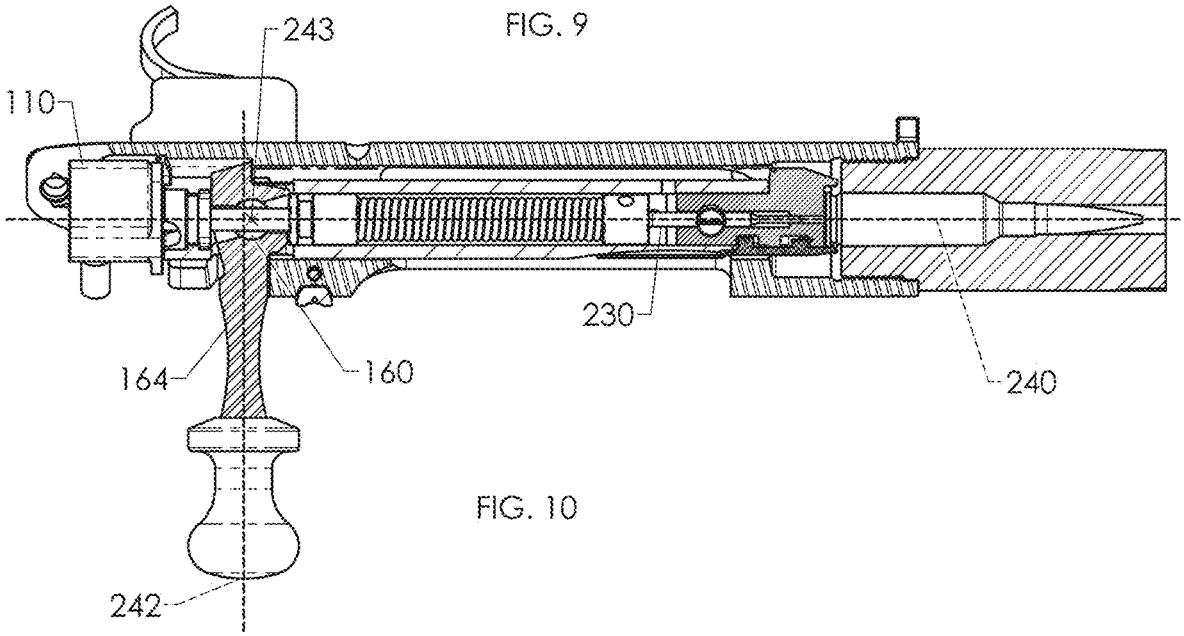
FIG. 10 is a cross-sectional view of the assembly taken along line 10-10 of FIG. 9.

FIG. 8 is an isometric view of the assembly 192 with the bolt mechanism 110 in an unlocked configuration. FIG. 9 is a front view of the assembly 192 of FIG. 8. FIG. 10 is a cross-sectional view of the assembly 192 taken along line 10-10 of FIG. 9. Referring to FIGS. 8-10, the handle 112 has been rotated upwardly about a longitudinal axis 240 (FIGS. 8 and 10) of the bolt mechanism 110. The arm 164 (FIG. 10) can be generally orthogonal to the longitudinal axis 240. For example, a longitudinal axis 242 (FIG. 10) of the arm 164 can be oriented generally perpendicular to the longitudinal axis 240 of the bolt mechanism 110. Referring to FIG. 10, the handle pin 160 defines the transverse axis of rotation 243 passing generally diametrically across the bolt mechanism 110. The lug 229 has been moved away from the forward-facing shoulder 228 (FIG. 7) to allow rearward movement of the bolt mechanism 110.

Figure 11:
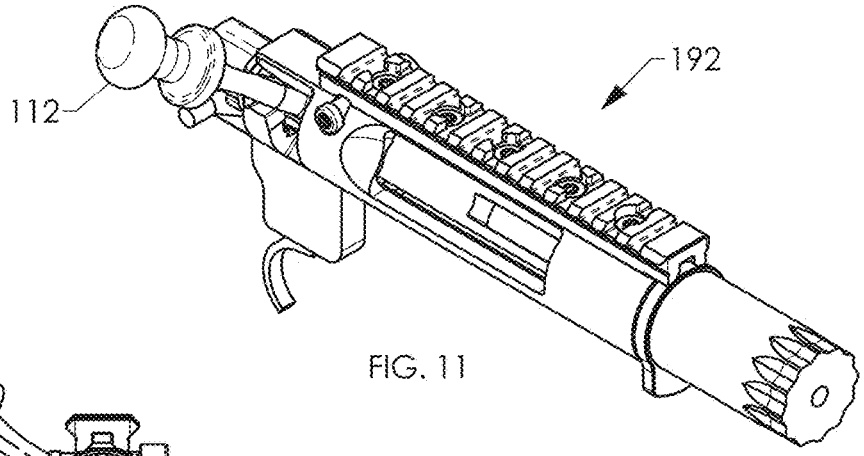
FIG. 11 is an isometric view of the action assembly with a bolt handle that has been pivoted to begin extraction of a cartridge in accordance with one embodiment.
Figure 12:
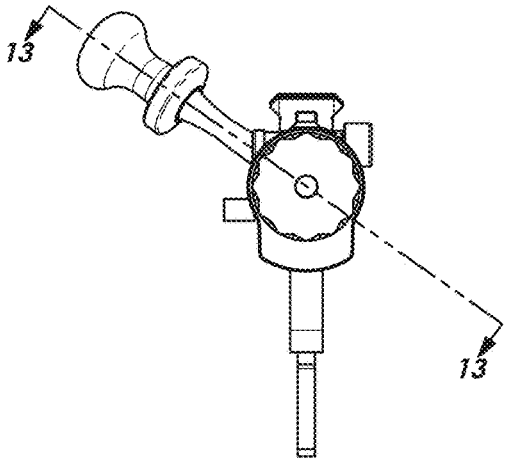
FIG. 12 is a front view of the assembly of FIG. 11.
Figure 13:
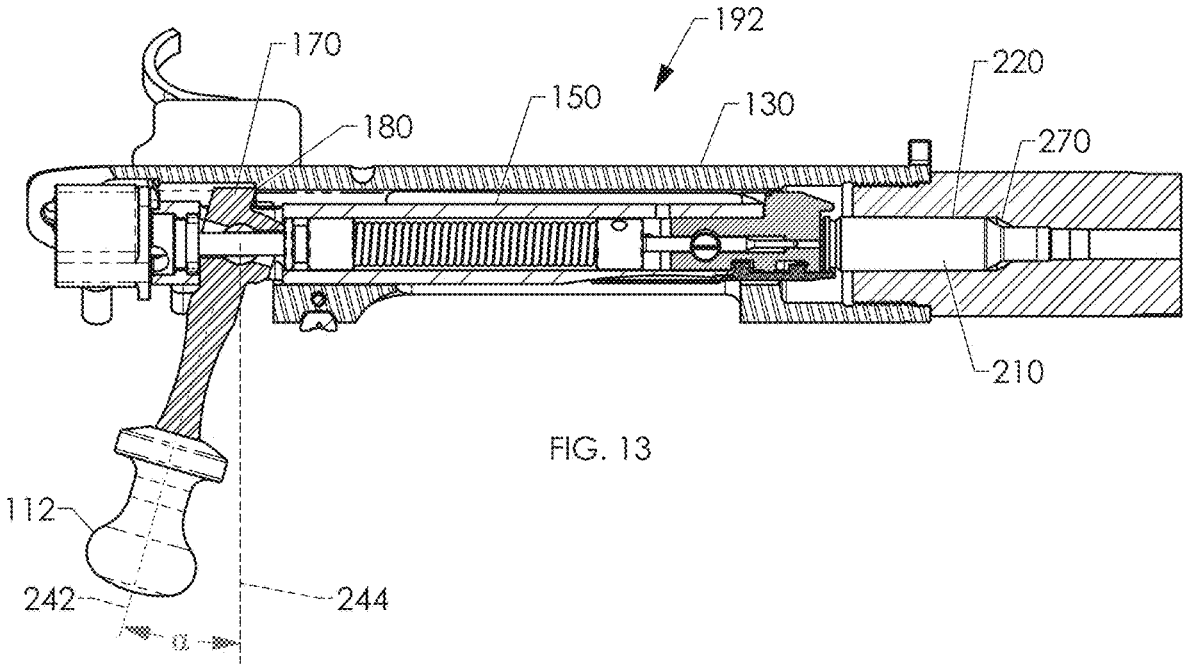
FIG. 13 is a cross-sectional view of the assembly taken along line 13-13 of FIG. 12.

FIG. 11 is an isometric view of the assembly 192 after the handle 112 has been rotated rearwardly to begin the cartridge case extraction process in accordance with one embodiment. FIG. 12 is a front view of the assembly 192 of FIG. 11. FIG. 13 is a cross-sectional view of the assembly 192 taken along line 13-13 of FIG. 12. As shown in FIG. 13, the longitudinal axis 242 of the handle 112 has been rotated an angle $\alpha$ from an initial position 244. The angle $\alpha$ can be equal to or greater than 5 degrees, 10 degrees, 15 degrees, 20 degrees, 25 degrees, 30 degrees, 40 degrees, 50 degrees, or any other angle selected based on the desired amount of handle movement. The handle shoulder 170 presses against the receiver shoulder 180, as discussed in connection with FIGS. 2 and 3, to drive the bolt mechanism 110 in the rearward direction to at least partially extract the spent cartridge 210 from the chamber 220. FIG. 13 shows a gap 270 after the spent cartridge has been dislodged.

Figure 14:
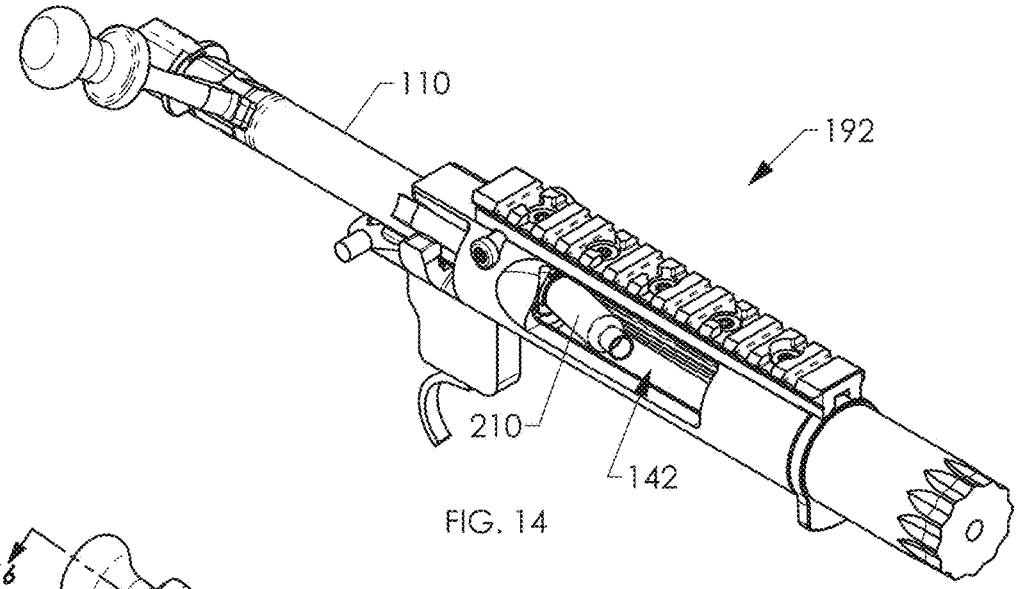
FIG. 14 is an isometric view of the assembly with the bolt handle in a rearward extraction position for discharging a spent case or shell via an ejection port.
Figure 15:
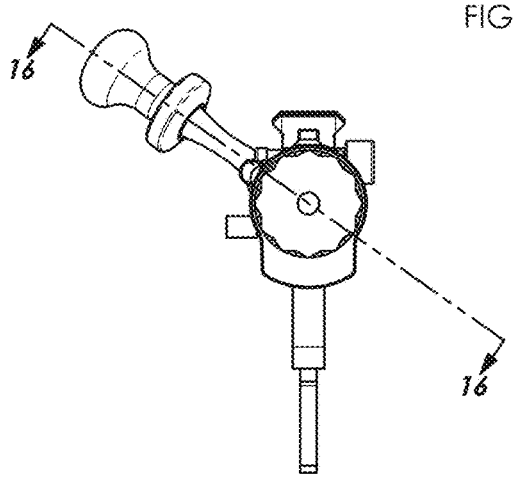
FIG. 15 is a front view of the assembly of FIG. 14.
Figure 16:
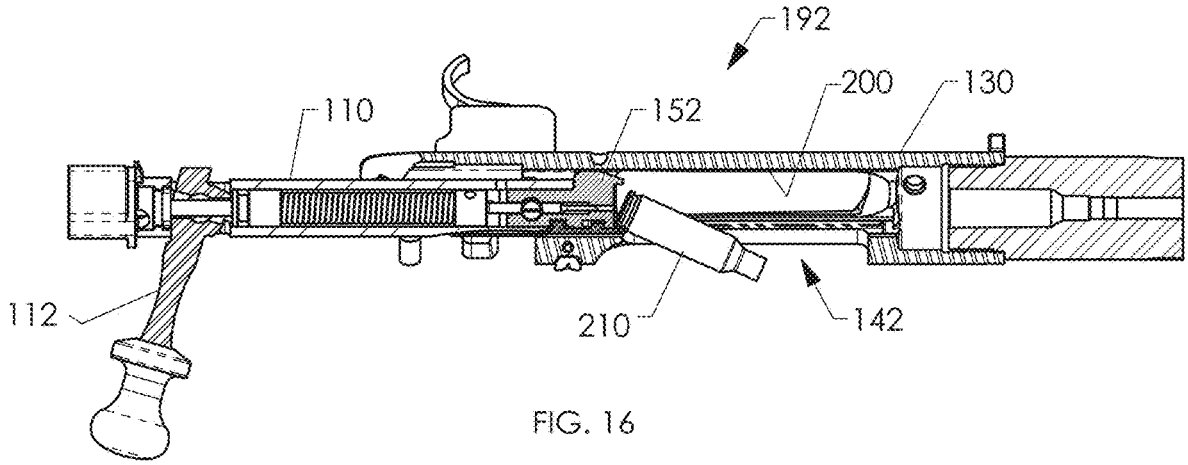
FIG. 16 is a cross-sectional view of the assembly taken along line 16-16 of FIG. 15.

FIG. 14 is an isometric view of the assembly 192 with the bolt mechanism 110 in rearward position for discharging the spent cartridge 210 via the ejection port 142. FIG. 15 is a front view of the assembly 192 of FIG. 14. FIG. 16 is a cross-sectional view of the assembly 192 taken along line 16-16 of FIG. 15. Referring now to FIG. 16, the handle 112 can remain in the rotated position while the bolt mechanism 110 slides along the passageway 200 of the receiver 130. To reload the firearm, the bolt mechanism 110 can be returned to the locked position discussed in connection with FIGS. 5-7.

Figure 17:
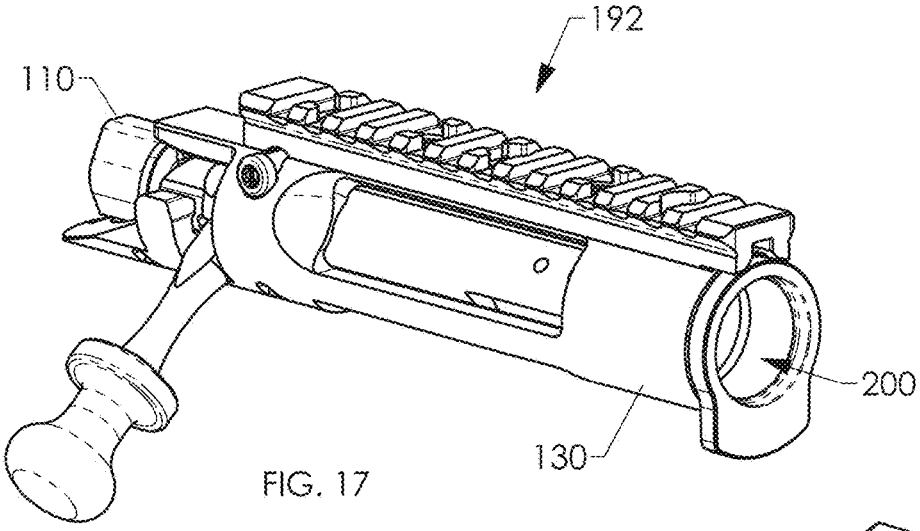
FIG. 17 is a front isometric view of a bolt mechanism/receiver assembly in accordance with one or more embodiments.
Figure 18:
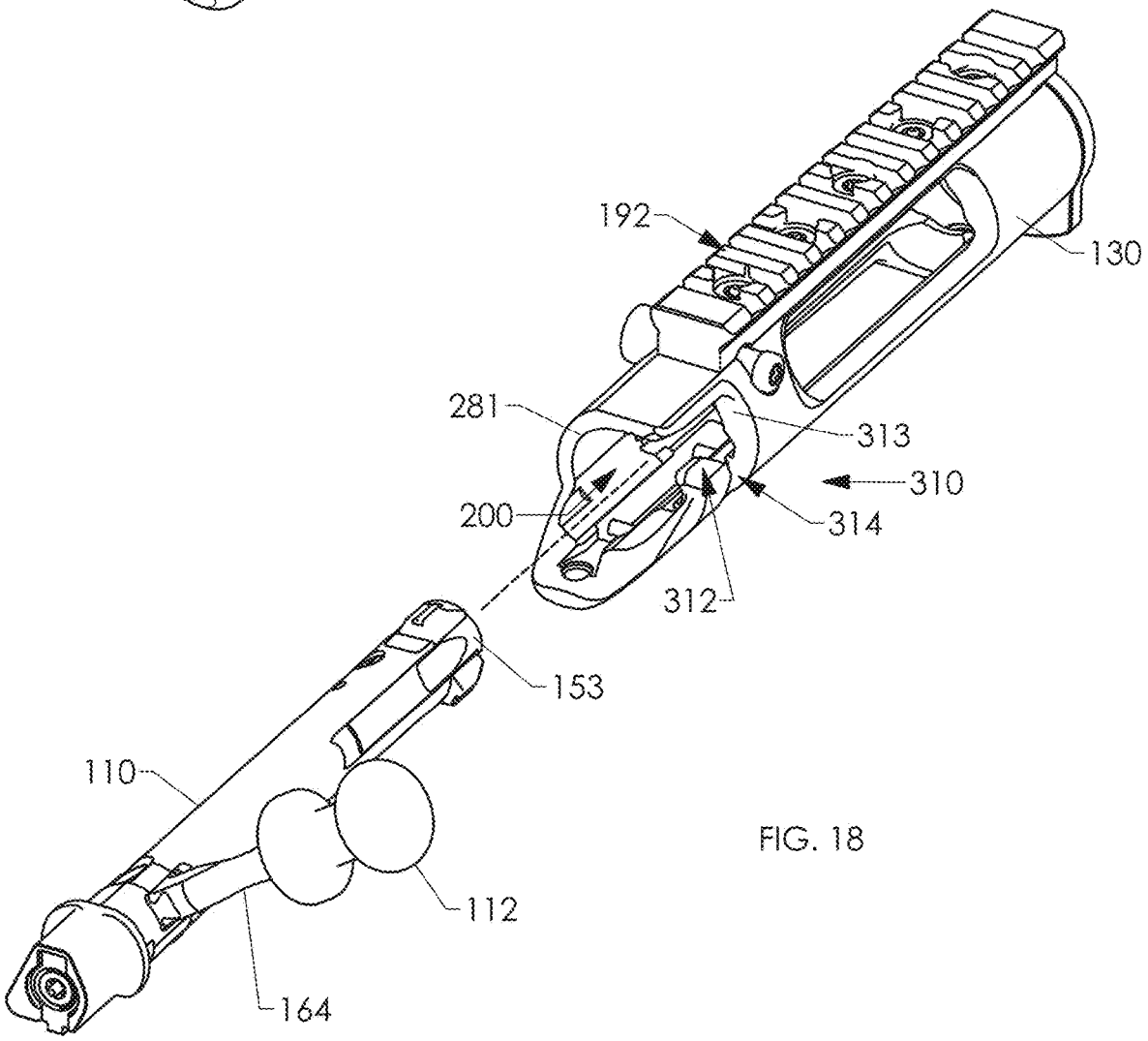
FIG. 18 is a rear exploded isometric view of the assembly of FIG. 17.

FIG. 17 is a front right-side isometric view of the assembly 192 in accordance with one or more embodiments. FIG. 18 is an exploded rear right-side isometric view of the assembly 192. Referring now to FIG. 18, the bolt mechanism 110 can be inserted into a rearward portion 281 of the receiver 130. The extractor assembly 153 can be moved along the passageway 200 until the arm 164 is aligned with a slotted region 310. The arm 164 can be moved distally along a longitudinal slot 312, and once the arm 164 reaches a forward position against an abutment 313, the handle 112 can be rotated vertically downward along a vertical slot 314. Components of the bolt mechanism 110 in accordance with one embodiment are discussed in connection with FIGS. 19-29. Another bolt mechanism is discussed in connection with FIGS. 29-34.

Bolt Mechanisms

Figure 19:
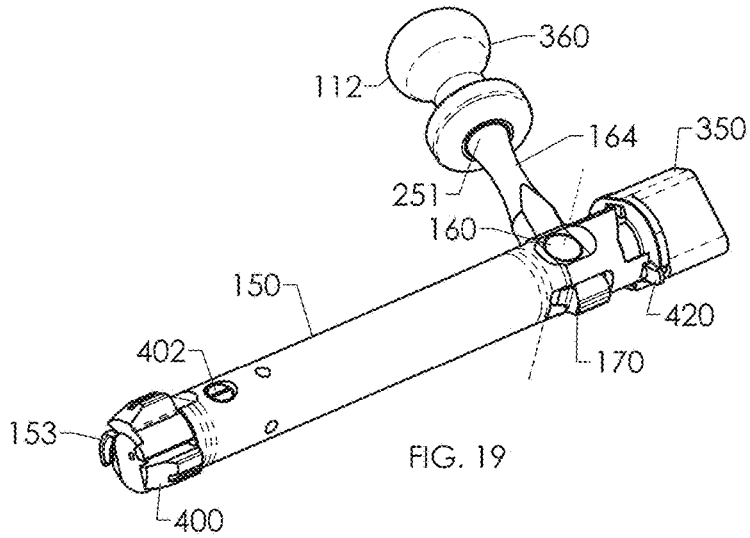
FIG. 19 is an isometric view of the bolt assembly in accordance with an embodiment.
Figure 20:
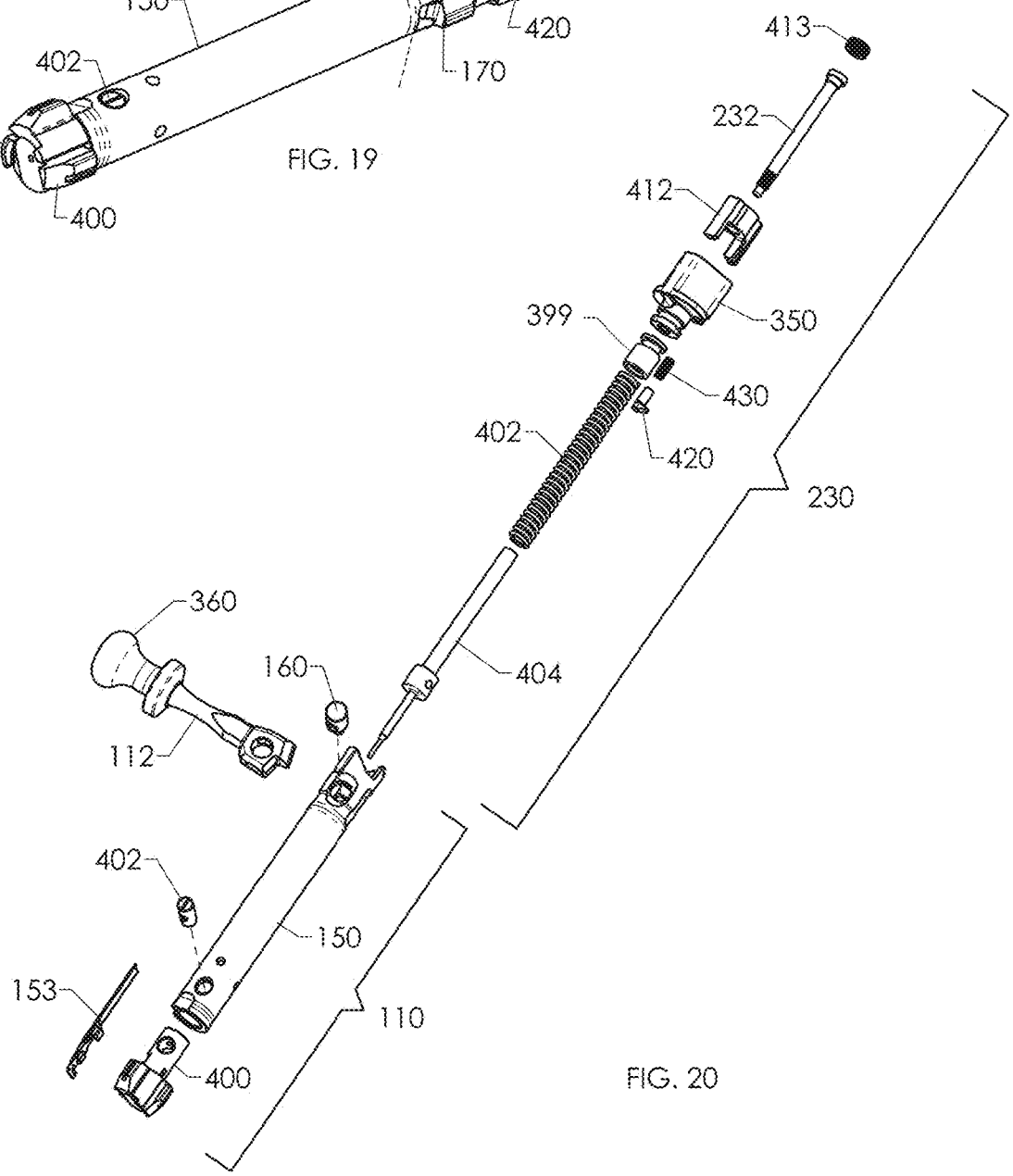
FIG. 20 is an exploded view of the bolt assembly of FIG. 19.

FIG. 19 is an isometric view of the bolt mechanism 110 in accordance with an embodiment. FIG. 20 is an exploded view of the bolt mechanism 110. The bolt mechanism 110 can include the handle 112, the bolt body 150, the extractor assembly 153, and a shroud 350. The handle 112 can include a knob 360 fixedly or rotatably coupled to an end portion 251 of the arm 164. The configuration of the arm 164 can be selected based on the desired gripping capabilities. The arm 164 and the shoulder 170 protrude from diametrically opposed sides of the bolt body 150. The pin 160 extends transversely across the bolt body 150 and is located generally between the arm 164 and the shoulder 170.

Referring to FIG. 20, a striker screw lock 413 can be coupled to the striker screw 232. A shroud 350 can be coupled to the bolt body 150 by a shroud locking pin 420 and spring 430. A firing pin assembly 230 can include a striker bushing 399, a striker spring 402, a striker 404, and the striker screw 232. The striker screw 232 can extend through a cocking piece 412, the shroud 350, and the pin 160. The configuration of the firing pin assembly 230 can be selected based on the configuration of the bolt mechanism 110.

A bolt head member 400 can be connected to the bolt body 150 by a bolt head pin 402. This arrangement may or can allow for rotation between the bolt head member 400 and bolt body 150. Exemplary bolt heads, bolt head members, extractor assemblies, and connections are disclosed in U.S. Pat. Nos. 9,097,478 and 9,574,834, which are incorporated by reference in their entireties. In some embodiments, the bolt head can be fixedly coupled to the bolt body 150. For example, the bolt head member 400 can have one or more lugs and can be rotatably fixed to the bolt body 150. The bolt body 150 can include a one-piece or multi-piece main cylindrical body configured to surround internal components. The configuration and functionality of the bolt head can be selected based on the desired interaction with receiver and/or the cartridge.

Figure 21:
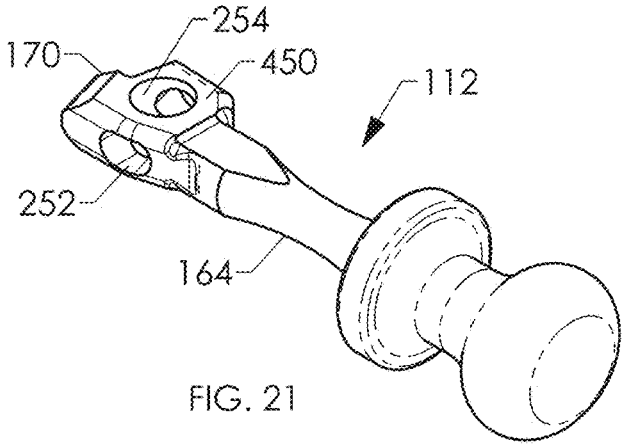
FIG. 21 is an isometric view of a bolt handle in accordance with one embodiment.
Figure 22:
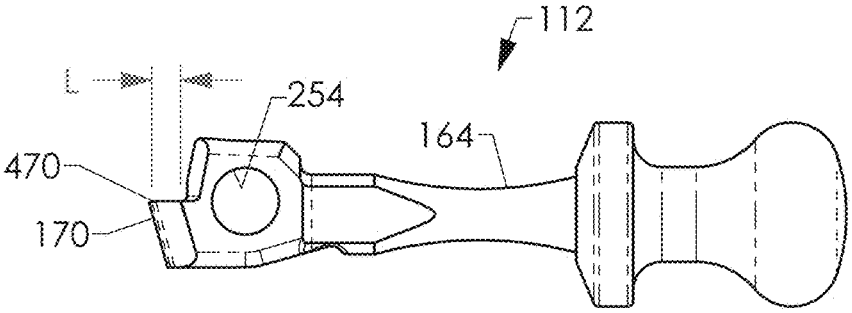
FIG. 22 is a plan view of the bolt handle.
Figure 23:
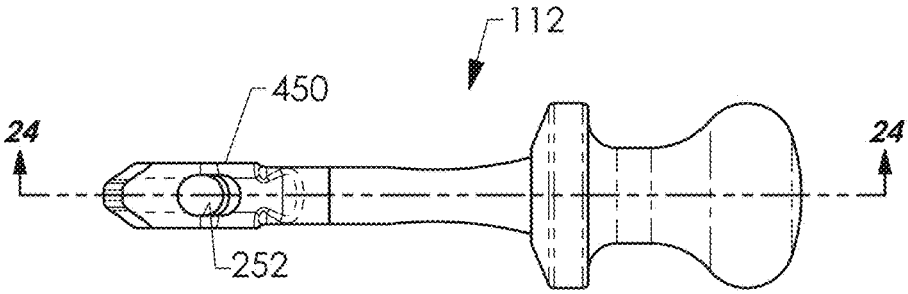
FIG. 23 is a side view of the bolt handle.
Figure 24:
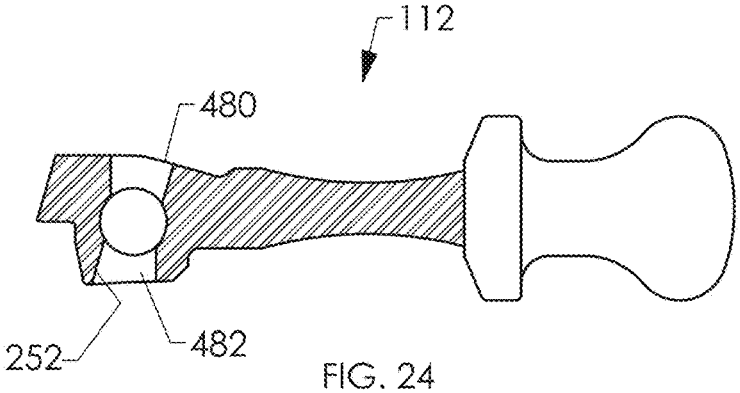
FIG. 24 is a cross-sectional view of the bolt handle taken along line 24-24 of FIG. 23.

FIG. 21 is an isometric view of the bolt handle 112 in accordance with one embodiment. FIG. 22 is a plan view of the bolt handle 112. FIG. 23 is a side view of the bolt handle 112. FIG. 24 is a cross-sectional view of the bolt handle 112 taken along line 24-24 of FIG. 23. Referring now to FIG. 21, the bolt handle 112 can include a main body 450 between the arm 164 and the shoulder 170. The main body 450 can include the firing pin assembly opening 252 and the pivot pin opening 254. The firing pin assembly opening 252 can be aligned with a firing pin passage in the bolt body (FIG. 7) to allow the firing pin assembly to extend through the entire bolt assembly. In some embodiments, the pin opening 254 can intersect with the firing pin passage 252 to allow the handle pin 160 to extend past at least a portion of the firing pin assembly.

Referring now to FIG. 22, the shoulder 170 can have a bearing surface 470 configured to bear against the receiver. The bearing surface 470 can be generally planar, curved, or have any configuration suitable for engaging the receiver. The length L of the shoulder 170 can be selected based on the dimensions of the shoulder of the receiver. In some embodiments, the length L is equal to or less than about 10 mm, 5 mm, 2 mm, or 1 mm. Other lengths L can be used.

Referring now to FIG. 23, the firing pin passage 252 can have an elliptical cross section, circular cross section, or any other suitable cross section for allowing rotation of the handle 112 with respect to the firing pin assembly. FIG. 24 shows the passageway 252 having widened ends 480, 482. This allows the handle 112 to be rotated back and forth without damaging the striker screw.

Figure 25:
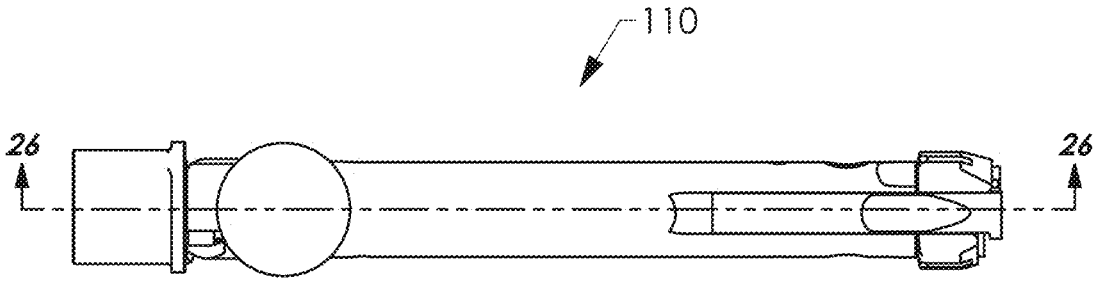
FIG. 25 is a side view of a bolt mechanism in accordance with one embodiment.
Figure 26:
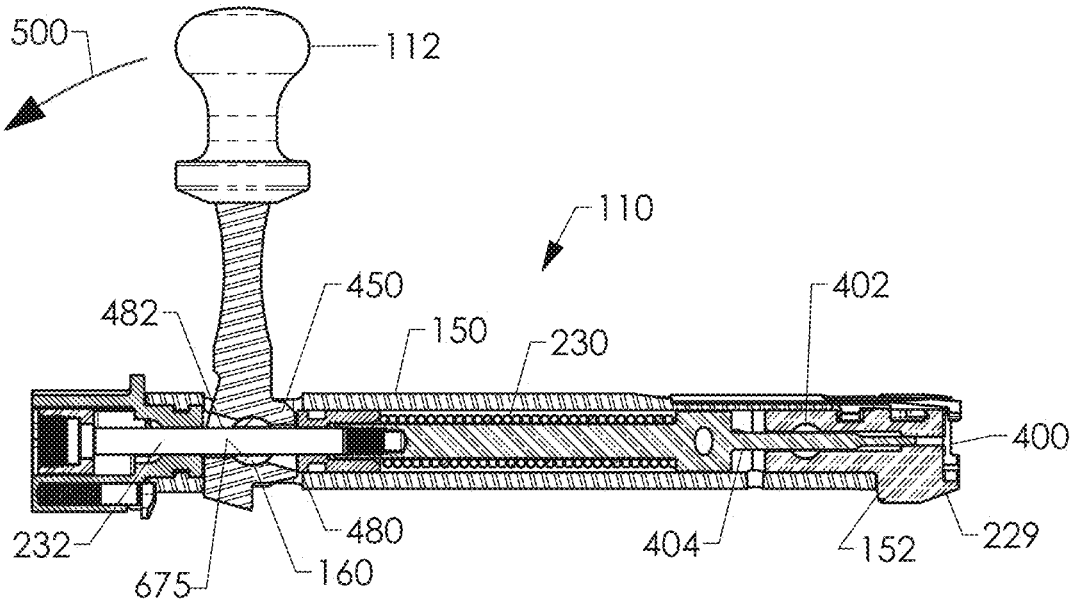
FIG. 26 is a cross-sectional view of the bolt mechanism taken along line 26-26 of FIG. 25.

FIG. 25 is a side view of the bolt mechanism 110 in accordance with an embodiment. FIG. 26 is a cross-sectional view of the bolt mechanism 110 taken along line 26-26 of FIG. 25. Referring now to FIG. 26, the generally cylindrical bolt body 150 surrounds internal components of the firing pin assembly 230. The bolt head 400 is rotatable relative to the striker 404 via the bolt head pin 402. As the handle 112 rotates (indicated by arrow 500), the internal components of the bolt mechanism 110 can remain generally stationary with respect to one another.

Figure 27:
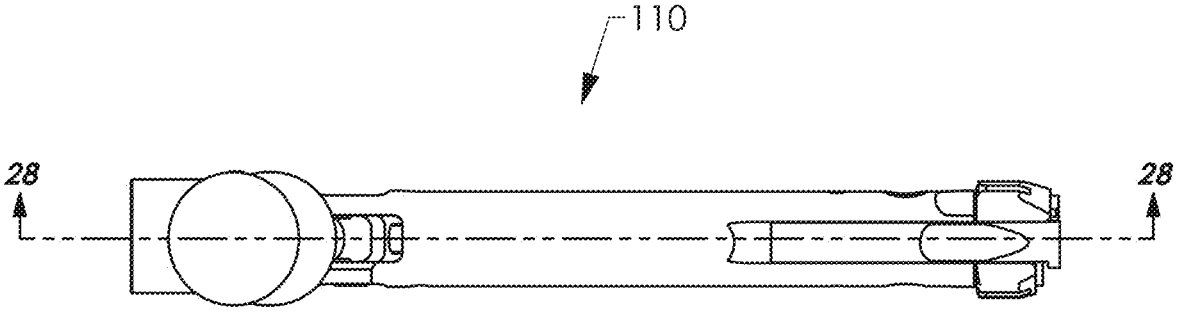
FIG. 27 is a side view of the bolt assembly in accordance with an embodiment.
Figure 28:
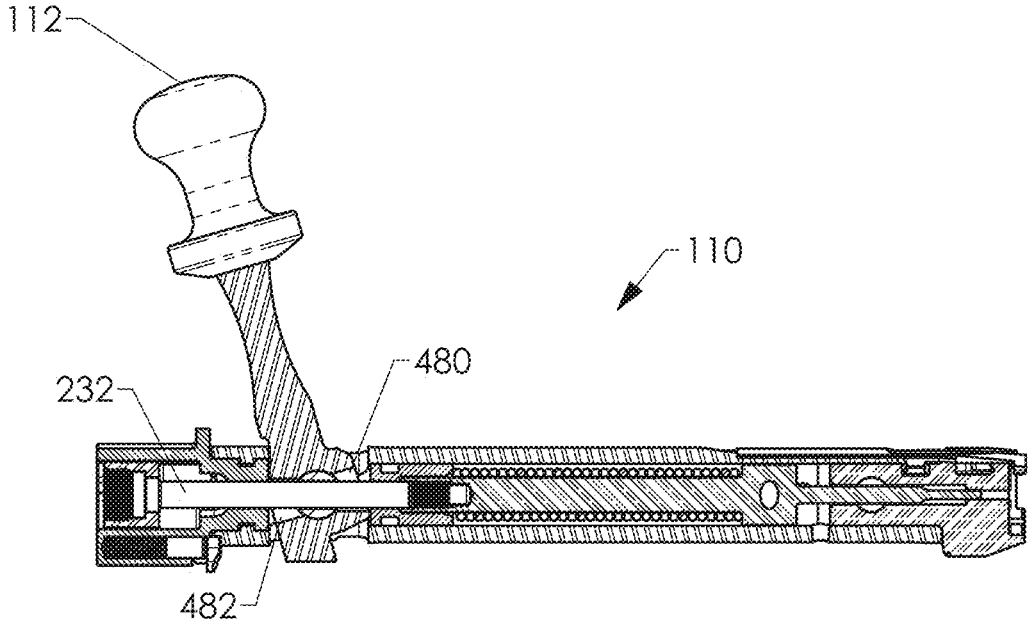
FIG. 28 is a cross-sectional view of the bolt assembly taken along line 28-28 of FIG. 27.

FIG. 27 is a side view of the bolt mechanism 110 in accordance with an embodiment. FIG. 28 is a cross-sectional view of the bolt mechanism 110 taken along line 28-28 of FIG. 27. As shown in FIGS. 26 and 28, the striker screw 232 can be located at the opposite side of the widened ends 480, 482 when the handle 112 is in an initial position (FIG. 26) and the fully rotated position (FIG. 28).

Figure 29:
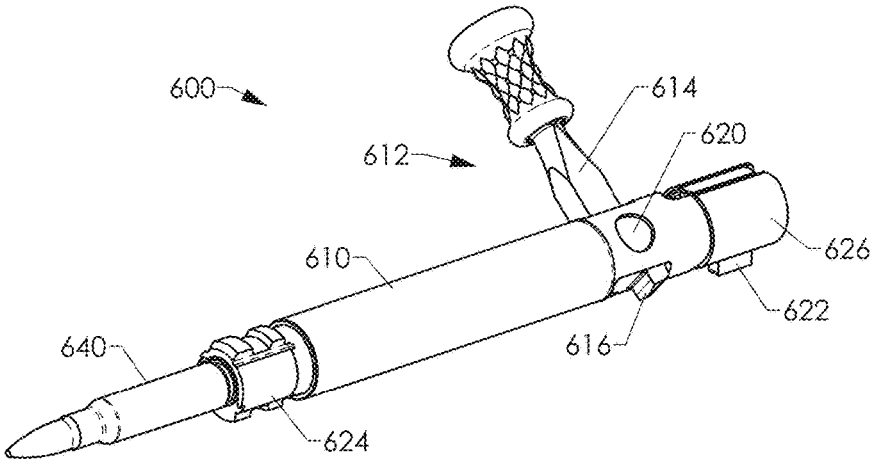
FIG. 29 is an isometric view of a bolt assembly in accordance with another embodiment.

FIG. 29 is an isometric view of a bolt mechanism 600 in accordance with another embodiment. The bolt mechanism 600 can include a bolt body 610 and a handle 612. The handle 612 includes an arm 614 and a shoulder 616. The shoulder 616 protrudes from the bolt body 610 for contacting receiver so that the bolt body 610 can be levered rearwardly to extract cartridges from a chamber. A handle pivot 620 allows rotation of the handle 612 relative to other components of the bolt assembly 600. The bolt mechanism 600 can further include a bolt shroud 626, a cocking piece 622, and a bolt head 624.

Figure 30:
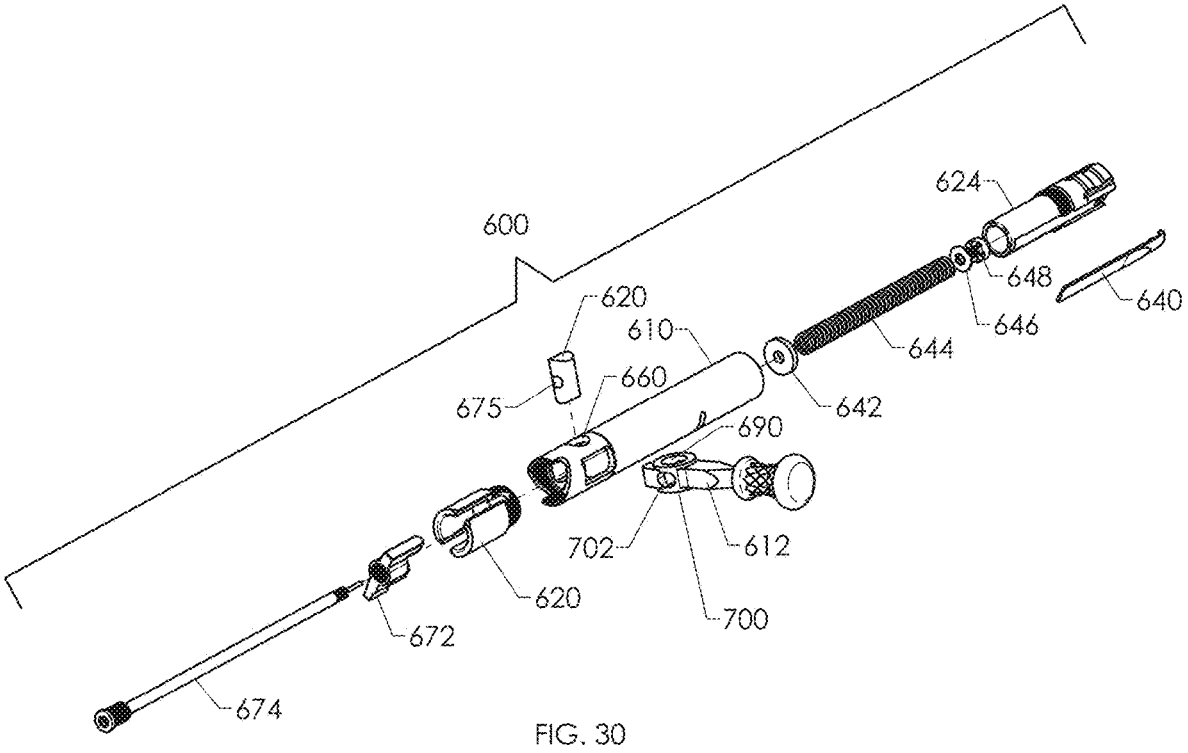
FIG. 30 is an exploded isometric view of the bolt assembly of FIG. 29.

FIG. 30 is an exploded view of the bolt mechanism 600 of FIG. 29. An extractor 640 can be adjacent to the bolt head 624 and can be configured to hold the rim of a cartridge. The bolt body 610 can house and surround a thrust washer 642, a firing pin spring 644, and other components. A spring retaining washer 646 and a spring retainer 648 can be received within the passageway of the bolt head member 624. The pin 620 can extend through an opening 660 in the bolt body 610. The opening 660 can be slightly larger than the pin 620 to prevent or limit frictional forces that would inhibit fore-aft rotation of the handle 612. The bolt mechanism 600 can further include a striker pin 674. The striker pin 674 can extend through the cocking piece 672 and an opening 675 in the pin 620. The pin 620 can be positioned within an opening 690 in a main body 700 of the handle 612. The striker pin 674 can extend through a striker pin passageway 702 of the main body 700.

Figure 31:
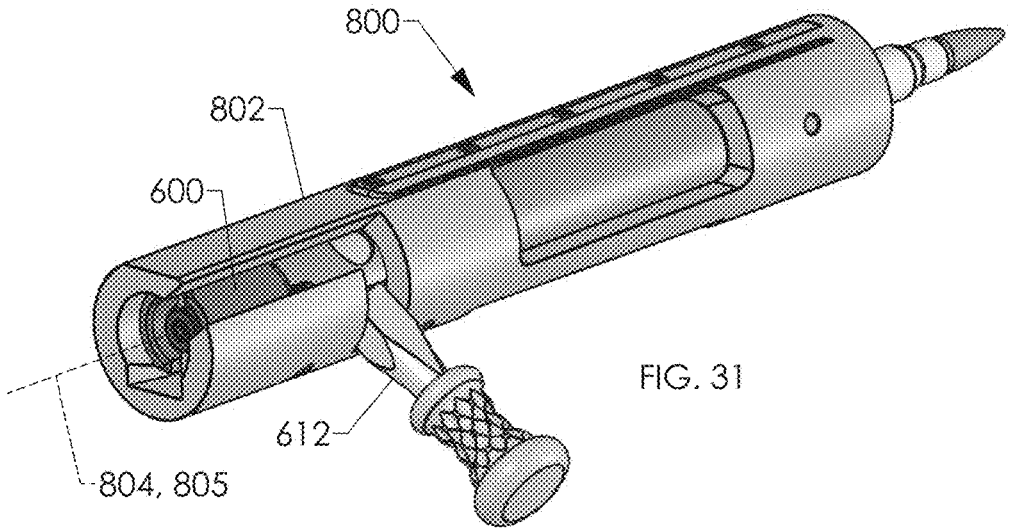
FIG. 31 is an isometric view of a bolt mechanism/receiver assembly with a bolt mechanism in a locked configuration in accordance with an embodiment.
Figure 32:
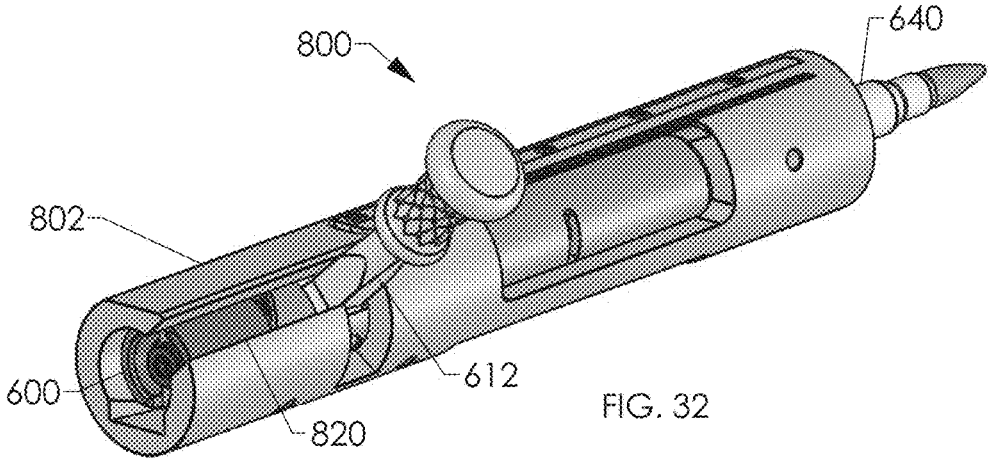
FIG. 32 is an isometric view of the assembly of FIG. 31 with a bolt mechanism in an unlocked position.

FIGS. 31 and 32 illustrate an assembly 800 that includes the bolt mechanism 600 and a receiver 802. Referring now to FIG. 31, the handle 612 is at a forward lowered position to lock the bolt mechanism 600. The handle 612 can be rotated upwardly about an axis of rotation 804 that can be substantially aligned with or parallel to a longitudinal axis 805 of the bolt mechanism 600. FIG. 32 shows the handle 612 in a forward raised position. As the handle 612 pivots, the shoulder (e.g., shoulder 616 of FIG. 29) can push against the receiver to utilize the mechanical advantage of leverage offered by the pivoting handle 612. In this manner, the handle 612 forcefully extracts the cartridge 640 from the chamber. The handle 612 can be pulled rearwardly through a longitudinal slot 820 of the receiver 802.

Figure 33:
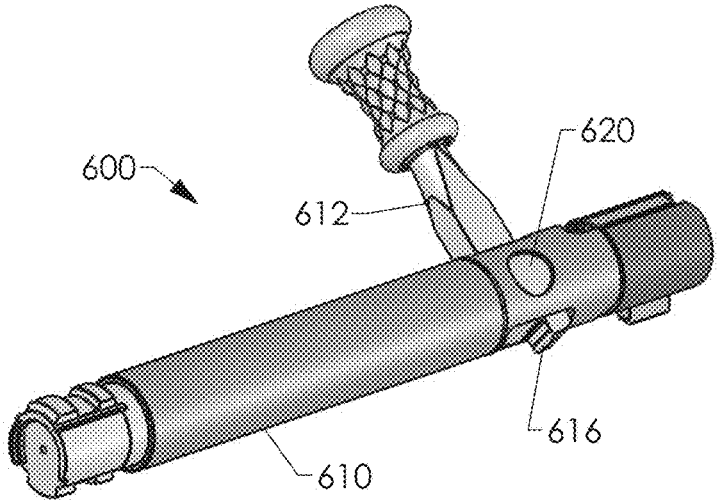
FIG. 33 shows internal components of the assembly of FIG. 31.
Figure 34:
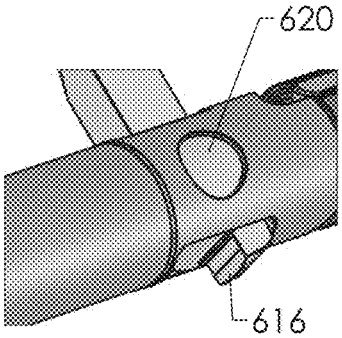
FIG. 34 is a detailed view of a portion of the assembly of FIG. 33.

FIG. 33 shows the bolt mechanism 600. The pin 620 can be rotatably fixed with respect to one or more other components, such as the bolt body 610, striker pin 674 (FIG. 30), or other components. The configuration of the firing pin assembly and other internal components can be selected based on desired bolt action. For example, the illustrated embodiment is configured for right-handed operation. In other embodiments, the handle 612 can be located on the opposite side for left-handed operation. Additionally, the handle 612 and the shoulder 616 are located on opposite sides of the bolt body 610. This provides for a large mechanical advantage. In other embodiments, the shoulder 616 can be at other locations facing the receiver surface.

The embodiments, features, extractors, bolt mechanisms, methods and techniques described herein may, in some embodiments, be similar to and/or include any one or more of the embodiments, features, firing components, systems, devices, materials, methods and techniques described in U.S. Pat. Nos. 7,743,543; 8,572,885; application Ser. No. 13/771,021, U.S. Provisional Patent Application No. 61/600,477; and U.S. Provisional Patent Application No. 61/602,520. U.S. Pat. No. 7,743,543, U.S. patent application Ser. No. 13/771,021, U.S. Provisional Patent Application No. 61/600,477; and U.S. Provisional Patent Application No. 61/602,520 are incorporated herein by reference in their entireties. In addition, the embodiments, features, systems, devices, materials, methods and techniques described herein may, in certain embodiments, be applied to or used in connection with any one or more of the embodiments, firearms, features, systems, devices, materials, methods and techniques disclosed in the above-mentioned U.S. Pat. No. 7,743,543; U.S. Provisional Patent Application No. 61/600,477; and U.S. Provisional Patent Application No. 61/602,520. The bolt mechanisms and other features disclosed herein can be incorporated into a wide range of different firearms (e.g., rifle, pistol, or other portable guns) to receive cartridges and removing empty cartridge shells. The following patents and applications are incorporated by reference: U.S. Pat. Nos. 7,743,543; 8,572,885; 9,097,478; 9,377,255. All patents, applications, and publications referenced herein are hereby incorporated by reference in their entireties.

From the foregoing, it will be appreciated that specific embodiments of the invention have been described herein for purposes of illustration, but well-known structures and functions have not been shown or described in detail to avoid unnecessarily obscuring the description of at least some embodiments of the invention. Where the context permits, singular or plural terms may also include the plural or singular term, respectively. Unless the word "or" is associated with an express clause indicating that the word should be limited to mean only a single item exclusive from the other items in reference to a list of two or more items, then the use of "or" in such a list shall be interpreted as including (a) any single item in the list, (b) all of the items in the list, or (c) any combination of the items in the list. The singular forms "a," "an," and "the" include plural referents unless the context clearly indicates otherwise. Thus, for example, reference to "a spring" refers to one or more springs, such as two or more springs, three or more springs, or four or more springs.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An assembly for a firearm, comprising:
a receiver having a receiver shoulder; and
a bolt mechanism including
a bolt body positionable in the receiver and positionable between the receiver shoulder and an ejection port of the receiver,
a handle pin, and
a handle extending through the bolt body and having an arm and a handle shoulder, wherein the arm and the handle shoulder are positioned on opposing longitudinal sides of the bolt body such that the handle shoulder contacts the receiver while the handle is rotated to lever the bolt mechanism rearwardly along the receiver, thereby extracting at least a portion of a cartridge from a chamber of the firearm.

2. The assembly of claim 1, wherein the handle pin is directly between the handle shoulder and the arm.

3. The assembly of claim 1, wherein the handle shoulder and the arm are positioned on opposites sides of a midplane plane of the bolt mechanism.

4. An assembly for a firearm, comprising:
a receiver having a receiver shoulder; and
a bolt mechanism including
a bolt body positionable in the receiver,
a handle pin, and
a handle extending through the bolt body and having an arm and a handle shoulder, wherein the arm and the handle shoulder are positioned on opposing longitudinal sides of the bolt body such that the handle shoulder contacts the receiver while the handle is rotated to lever the bolt mechanism rearwardly along the receiver, thereby extracting at least a portion of a cartridge from a chamber of the firearm, wherein the handle has a main body between the arm and the handle shoulder,
wherein at least a portion of the main body is positioned within the bolt body and includes
a pin opening through which the handle pin extends, and
a firing pin assembly opening configured to receive at least a portion of a firing pin assembly.

5. An assembly for a firearm, comprising:
a receiver having a receiver shoulder;
a bolt mechanism including
a bolt body positionable in the receiver,
a handle pin, and
a handle extending through the bolt body and having an arm and a handle shoulder, wherein the arm and the handle shoulder are positioned on opposing longitudinal sides of the bolt body such that the handle shoulder contacts the receiver while the handle is rotated to lever the bolt mechanism rearwardly along the receiver, thereby extracting at least a portion of a cartridge from a chamber of the firearm; and
a firing pin assembly passing through the handle pin.

6. An assembly for a firearm, comprising:
a receiver having a receiver shoulder; and
a bolt mechanism including
a bolt body positionable in the receiver,
a handle pin, and
a handle extending through the bolt body and having an arm and a handle shoulder, wherein the arm and the handle shoulder are positioned on opposing longitudinal sides of the bolt body such that the handle shoulder contacts the receiver while the handle is rotated to lever the bolt mechanism rearwardly along the receiver, thereby extracting at least a portion of a cartridge from a chamber of the firearm, wherein the handle pushes the bolt mechanism away from the chamber when the handle is rotated rearwardly, and wherein the bolt mechanism is configured to generate a force for displacing the bolt body rearwardly to cause extraction of the cartridge from the chamber of the firearm.

7. An assembly for a firearm, comprising:

a receiver having a receiver shoulder; and a bolt mechanism including a bolt body positionable in the receiver, a handle pin, and a handle extending through the bolt body and having an arm and a handle shoulder, wherein the arm and the handle shoulder are positioned on opposing longitudinal sides of the bolt body such that the handle shoulder contacts the receiver while the handle is rotated to lever the bolt mechanism rearwardly along the receiver, thereby extracting at least a portion of a cartridge from a chamber of the firearm wherein the handle includes a firing pin assembly opening larger than a firing pin extending through the bolt mechanism to allow sufficient rotation of the handle about the handle pin to displace a cartridge case relative to the chamber.

8. An assembly for a firearm, comprising:

a receiver having a receiver shoulder; and a bolt mechanism including a bolt body positionable in the receiver, a handle pin, and a handle extending through the bolt body and having an arm and a handle shoulder, wherein the arm and the handle shoulder are positioned on opposing longitudinal sides of the bolt body such that the handle shoulder contacts the receiver while the handle is rotated to lever the bolt mechanism rearwardly along the receiver, thereby extracting at least a portion of a cartridge from a chamber of the firearm, wherein the handle is movable from a lower forward position for firing the firearm to a raised forward position for allowing extraction of a cartridge case, wherein the handle shoulder contacts the receiver when the handle is rotated rearwardly away from the raised forward position.

9. An assembly for a firearm, comprising:

a receiver having a receiver shoulder; and a bolt mechanism including a bolt body positionable in the receiver, a handle pin, and a handle extending through the bolt body and having an arm and a handle shoulder, wherein the arm and the handle shoulder are positioned on opposing longitudinal sides of the bolt body such that the handle shoulder contacts the receiver while the handle is rotated to lever the bolt mechanism rearwardly along the receiver, thereby extracting at least a portion of a cartridge from a chamber of the firearm, wherein the handle includes a pivot hole through which the handle pin extends, and a firing pin assembly hole configured to receive a firing pin assembly such that the handle rotates relative to the firing pin assembly when the handle rotates relative to the bolt body.

10. The assembly of claim 9, wherein the pivot hole intersects the firing pin assembly hole.

11. An assembly for a firearm, comprising:

a receiver having a receiver shoulder; and a bolt mechanism including a bolt body positionable in the receiver, a handle pin, and a handle extending through the bolt body and having an arm and a handle shoulder, wherein the arm and the handle shoulder are positioned on opposing longitudinal sides of the bolt body such that the handle shoulder contacts the receiver while the handle is rotated to lever the bolt mechanism rearwardly along the receiver, thereby extracting at least a portion of a cartridge from a chamber of the firearm, wherein the handle pin defines a handle axis of rotation that extends through a firing pin assembly.

12. An assembly for a firearm, comprising:

a receiver having a receiver shoulder;

a bolt mechanism including a bolt body positionable in the receiver, a handle pin, and a handle extending through the bolt body and having an arm and a handle shoulder, wherein the arm and the handle shoulder are positioned on opposing longitudinal sides of the bolt body such that the handle shoulder contacts the receiver while the handle is rotated to lever the bolt mechanism rearwardly along the receiver, thereby extracting at least a portion of a cartridge from a chamber of the firearm; and a firing pin assembly extending through a portion of the handle positioned within the bolt body.

13. A bolt mechanism for a bolt action rifle, comprising:

a cylindrical main body;

a handle attached to the cylindrical main body by a pivot pin which engages the cylindrical main body; and a firing pin assembly extending through a portion of the handle within the cylindrical main body, wherein the firing pin assembly passes through the pivot pin.

14. The bolt mechanism of claim 13, wherein the handle is coupled to the cylindrical main body via a pinned connection.

15. The bolt mechanism of claim 13, wherein the handle is configured to cause translation of the cylindrical main body along a receiver while the main body is substantially rotationally fixed relative to the receiver.

16. A bolt mechanism for a bolt action rifle comprising:

a cylindrical main body, a handle pivotally connected to the cylindrical main body and having a short portion and a long portion, wherein the short portion protrudes from the side of the cylindrical main body opposite the long portion and is positionable to contact a receiver so that the bolt mechanism is levered in a rearward direction by rotation of the handle to extract a cartridge case from the chamber; and a firing pin assembly extending through a portion of the handle within the cylindrical main body.

* * * * *